US012054950B2

(12) United States Patent
De Frene et al.

(10) Patent No.: US 12,054,950 B2
(45) Date of Patent: Aug. 6, 2024

(54) TERRACE CANOPY

(71) Applicant: RENSON SUNPROTECTION-SCREENS, Waregem (BE)

(72) Inventors: Joost De Frene, Waregem (BE); Kristof Lemiegre, Gentbrugge (BE); Lennart De Meulemeester, Ledeberg (BE); Pieter Brabant, Rumbeke (BE); Thomas De Rycke, Ghent (BE)

(73) Assignee: RENSON SUNPROTECTION-SCREENS (BE)

( * ) Notice: Subject to any disclaimer, the term of this patent is extended or adjusted under 35 U.S.C. 154(b) by 190 days.

(21) Appl. No.: 17/919,841

(22) PCT Filed: Apr. 21, 2021

(86) PCT No.: PCT/IB2021/053278
§ 371 (c)(1),
(2) Date: Oct. 19, 2022

(87) PCT Pub. No.: WO2021/214675
PCT Pub. Date: Oct. 28, 2021

(65) Prior Publication Data

US 2023/0151614 A1 May 18, 2023

(30) Foreign Application Priority Data

Apr. 21, 2020 (BE) ..... 2020/5265

(51) Int. Cl.
*E04D 13/064* (2006.01)
*E04C 3/04* (2006.01)
(Continued)

(52) U.S. Cl.
CPC ..... *E04D 13/064* (2013.01); *E04C 3/07* (2013.01); *E04D 13/08* (2013.01);
(Continued)

(58) Field of Classification Search
CPC ..... E04C 3/07; E04C 2003/0413; E04C 2003/0439; E04C 2003/0465;
(Continued)

(56) References Cited

U.S. PATENT DOCUMENTS 3,222,841 A * 12/1965 Lipof ..... E04C 3/06 52/63
5,492,162 A * 2/1996 Lohausen ..... F16B 37/045 160/22
(Continued)

FOREIGN PATENT DOCUMENTS

BE 1021793 B1 1/2016
EP 2372072 A2 10/2011
(Continued)

OTHER PUBLICATIONS

International Search Report and Written Opinion for PCT Application No. PCT/IB2021/053278, dated Aug. 6, 2021, pp. 1-13.

*Primary Examiner* — Gisele D Ford
(74) *Attorney, Agent, or Firm* — Dickinson Wright PLLC

(57) ABSTRACT

Disclosed is a terrace canopy, comprising a beam having a top side, a bottom side, an inner side and an outer side, and, in its cross-section, is provided with a screen cavity which is delimited by an upright inner side wall and a horizontal top wall and an internal space above the screen cavity. An upright wall extends from the end of the horizontal top wall. The beam comprises either a first closure profile for closing off the internal space or a wall profile attached to the upright wall and a second closure profile for closing off the internal space. Thus, multiple configurations of the beam are possible and an additional wall holder may be provided on the outer side of the screen cavity such that a double side wall infill is possible.

20 Claims, 22 Drawing Sheets

(51) Int. Cl.
*E04C 3/07* (2006.01)
*E04D 13/08* (2006.01)

(52) U.S. Cl.
CPC ..... *E04C 2003/0413* (2013.01); *E04C 2003/0439* (2013.01); *E04C 2003/0465* (2013.01); *E04D 2013/0893* (2013.01)

(58) Field of Classification Search
CPC ..... E04D 2013/0893; E04D 13/08; E04D 13/064; E04F 10/0685; E04F 10/02; E04F 10/06; E04H 6/025; E04H 15/58; E04B 2001/2409; E04B 2001/2451; E06B 9/42
See application file for complete search history.

(56) References Cited

U.S. PATENT DOCUMENTS

| | | | | | |
|---|---|---|---|---|---|
| 5,673,739 | A * | 10/1997 | Brutsaert | E04F 10/0662 160/22 |
| 2016/0298332 | A1* | 10/2016 | Veys | E04C 3/32 |
| 2016/0333587 | A1* | 11/2016 | Veys | E04F 10/0685 |
| 2019/0271155 | A1* | 9/2019 | Gilbertson | H02G 3/386 |
| 2020/0340299 | A1* | 10/2020 | Snader | E06B 9/42 |
| 2022/0127905 | A1* | 4/2022 | Cortvriendt | E06B 9/42 |

FOREIGN PATENT DOCUMENTS

| | | | |
|---|---|---|---|
| IT | 201800001632 | A1 | 7/2019 |
| WO | 2015104675 | A1 | 7/2015 |

* cited by examiner

TERRACE CANOPY

CROSS-REFERENCE TO RELATED APPLICATION(S)

This present application is a national stage application of International Patent Application No. PCT/IB2021/053278, filed Apr. 21, 2021, which claims priority to Belgium Patent Application No. 2020/5265, filed Apr. 21, 2020, the disclosures of which are hereby incorporated by reference in their entireties.

TECHNICAL FIELD

The present invention relates to a terrace canopy.

STATE OF THE ART

Terrace canopies are usually set up to screen off or clear an outdoor area. For instance, such screen devices are often set up near houses, restaurants, shops, etc. to screen off an outdoor terrace or the like from sunlight, precipitation and/or wind, or conversely, to temporarily allow in sunlight. These terrace canopies can be implemented, for example, in the form of awnings, pergolas, verandas, carports, a pavilion, etc.

Such a terrace canopy typically comprises a roof frame that is at least partially supported by columns. Exceptionally, the roof frame may also be supported by another roof construction. The roof frame is generally constructed of several beams that are composed into one or more frames into which a roof infill can be attached. The beams themselves are often a composition of a plurality of individual profiles. Such a roof frame is typically supported by four (or more) columns between which a wall infill may be provided. Likewise, less columns may be used in case the roof frame is supported by other structures, such as a wall of an already existing structure.

The roof infill may be stationary or movable, for example, a retractable roof. The roof infill of a retractable roof may, for instance, consist of a rollable cloth or screen, slats that rotate around their axis, or of segments that can slide over each other. The segments may be panels that are partly made of (laminated) glass or plastic, such as PC or PMMA. Depending on the choice of material, the light transmission and robustness of the roof may be adjusted to the desired application. The wall infill can also be stationary or movable. Examples are a rollable cloth or screen or movable, i.e. slidable or foldable, panels.

A known problem with such terrace canopies is the amount of customization and/or the number of standard components that may be required to provide sufficient variation in the construction possibilities of the terrace canopy.

BE 2014/0015 discloses a terrace canopy which aims to at least partially solve the aforementioned problem. BE 2014/0015 discloses a beam for a terrace canopy, which beam is provided with an internal cavity for the purpose of draining precipitation incident on the terrace canopy, to a front end of the beam. Above the cavity, a space is provided in which a screen roll can be arranged which can be downwardly unrolled, the screen then being located between the cavity and the outer side (formed by the front cover of the beam).

In practice, it is also possible to use other types of wall infill, in particular sliding panel walls, with the beam disclosed in BE 2014/0015. To this end, the screen cavity is closed at the bottom side and an additional wall profile is attached to the bottom side of the beam.

However, by attaching an additional wall profile, the total size of the beam increases, which is undesirable, among others, for reasons such as possible changes in the headroom, wind load and aesthetic appearance. In addition, a seam can be seen between the beam and the wall profile, which is visually undesirable.

In summary, it has turned out in practice that the beam disclosed in BE 2014/0015 still offers too little the possibility of an integration of the different types of side wall infill that are common with terrace canopies.

DESCRIPTION OF THE INVENTION

It is an object of the present invention to provide a beam for a terrace canopy that allows more integration of the types side wall infill common with terrace canopies.

This object is realized by a terrace canopy comprising a beam, the beam having a top side, a bottom side, an inner side and an outer side, and comprising a base part that, in its cross-section, is provided with: a screen cavity configured to hold a screen roller, which screen cavity is delimited by an upright inner side wall and a horizontal top wall extending from the upright inner side wall in the direction of the outer side of the beam; an upright outer side wall extending from the end of the horizontal top wall and provided at the top with a first upper connection means; and an internal space above the screen cavity, wherein the upright outer side wall, on its outwardly facing side, is provided with a first connection means and in that the beam is further provided with: a first closure profile closing off the internal space and provided with a first complementary connection means, the first closure profile being connected to the base part by connecting its first complementary connection means to the first upper connection means; or a wall profile and a second closure profile, wherein the wall profile is located on the outer side of the upright outer side wall and is configured to guide and/or hold a wall panel and is provided with a first complementary connection means, a second complementary connection means and a first upper connection means, the wall profile being connected to the base member by connecting its first complementary connection means to the first upper connection means and its second complementary connection means to the first connection means, wherein the second closure profile closes off the internal space and is provided with a first complementary connection means, wherein the second closure profile is connected to the wall profile by connecting its first complementary connection means to the first upper connection means of the wall profile.

By providing the necessary connection means on the base profile, it is possible to obtain functionally different beams. On the one hand, it is possible not to provide a wall profile and to close the beam at its top with a first closure profile. On the other hand, a wall profile can be provided on the outer side of the screen cavity and the top side of the beam (incl. the wall profile) is then closed off with a second closure profile. Such additional functionality on the outer side of the beam allows, i.a., to obtain a double wall infill. In addition, this extra functionality is obtained by using the same connection means for multiple applications, avoiding the need for additional connection means.

In an embodiment of the present invention, the upright inner side wall is provided at the top with a second upper connection means, the first closure profile and the second closure profile each being provided with a second complementary connection means, wherein the first closure profile is connected to the base part by means of connecting its second complementary connection means to the second upper connection means and wherein the second closure profile is connected to the base member by connecting its second complementary connection means to the second upper connection means. Preferably, the second upper connection means comprises a female pin connection means and the second complementary connection means comprises a male pin connection means. In this way, each closure profile is connected to the beam at two places. This contributes to the strength and mutual positioning of the profiles. The fact is that, if only one connection is used for two profiles, there is more clearance in the mutual positioning, which can give rise to a divergent positioning, in particular due to wind loads and/or precipitation.

In an embodiment of the present invention, the first upper connection means comprises a female pin connection means and the first complementary connection means of each closure profile includes a male pin connection means.

In an embodiment of the present invention, the first upper connection means and the first connection means each comprise a hook element and the first complementary connection means and said second complementary connection means of the wall profile comprise a hook member.

Such connection means are simple to use and can also be provided during an extrusion process such that they can be manufactured integrally with (the base part of) the beam.

In an embodiment of the present invention, the first upper connection means comprises a female pin connection means and a hook element. In this way, different connection methods are combined in one connection means such that the beam can be embodied more compact.

In an embodiment of the present invention, the internal space is delimited by the horizontal top wall, the upright outer side wall and the upright inner side wall. This internal space can be used, for example, as a technical space for the placement of motors and/or motor controls for the drive of a slatted roof and/or the guiding of electrical cables.

In an embodiment of the present invention, the outwardly facing surface of the second closure profile and the outwardly facing surface of the outer side wall of the wall profile lie substantially in the same plane. In other words, the outer side of the beam forms substantially a single plane, which is aesthetically desirable.

In an embodiment of the present invention, the beam comprises a gutter part located below the base section and configured to drain precipitation incident on the terrace canopy to a front end of the beam. Preferably, the base part and the gutter part are formed as separate profiles, wherein the upright inner side wall of the base profile at the bottom is provided with at least one, preferably at least two, connection means and in that the gutter profile is provided with at least one, preferably at least two corresponding connection means for connecting the base profile to the gutter profile. The gutter part provides the desired water drainage of the terrace canopy. The use of separate profiles has the advantage that the beam is easier to manufacture. Namely, it has been found that an extrusion process for manufacturing one profile in which the base part and the gutter part are incorporated, is technically difficult to realize, in particular in view of the considerable height of such a profile.

In an embodiment of the present invention is the horizontal top wall near its end provided with a second connection means which, preferably, comprises a plurality of connection means.

In general, among other things for the strength and mutual positioning, use should be made of two separate connections per interconnection of two profiles. The fact is that if only one connection is used for two profiles, there is more clearance in the mutual positioning, which can give rise to a divergent positioning, in particular due to wind loads and/or precipitation.

Hence, in the canopy disclosed in BE 2014/0015, the base portion of the beam is provided with a first attachment means near the end of the horizontal wall and a second attachment means near an end of an upright wall extending from the location of the first attachment means such that there is a certain moderate distance between the attachment means. This means that the space between the two attachment means, after placing a further profile, such as a front cover, cannot contribute to the variation in functionality of the beams.

It is therefore advantageous to provide two connection means near the end of the horizontal wall, as opposed to only one connection means in the beam of BE 2014/0015. In particular, the two connection means allow to connect several functionally different profiles with the end of the horizontal wall without having to provide a connection at another location of the base part, as is the case in BE 2014/0015. Therefore, there is less loss of space in the base part.

In an embodiment of the present invention, the wall profile comprises a rail configured for guiding at least one wall portion. By integrating the rail into the beam, there is no longer any need for guiding on the bottom side of the wall parts, such that they cannot form an obstacle to a smooth passage under the canopy if the wall parts are open.

BRIEF DESCRIPTION OF THE DRAWINGS

The invention will hereinafter further be explained in detail with reference to the following description and to the accompanying drawings.

EMBODIMENTS OF THE INVENTION

Figure 1:
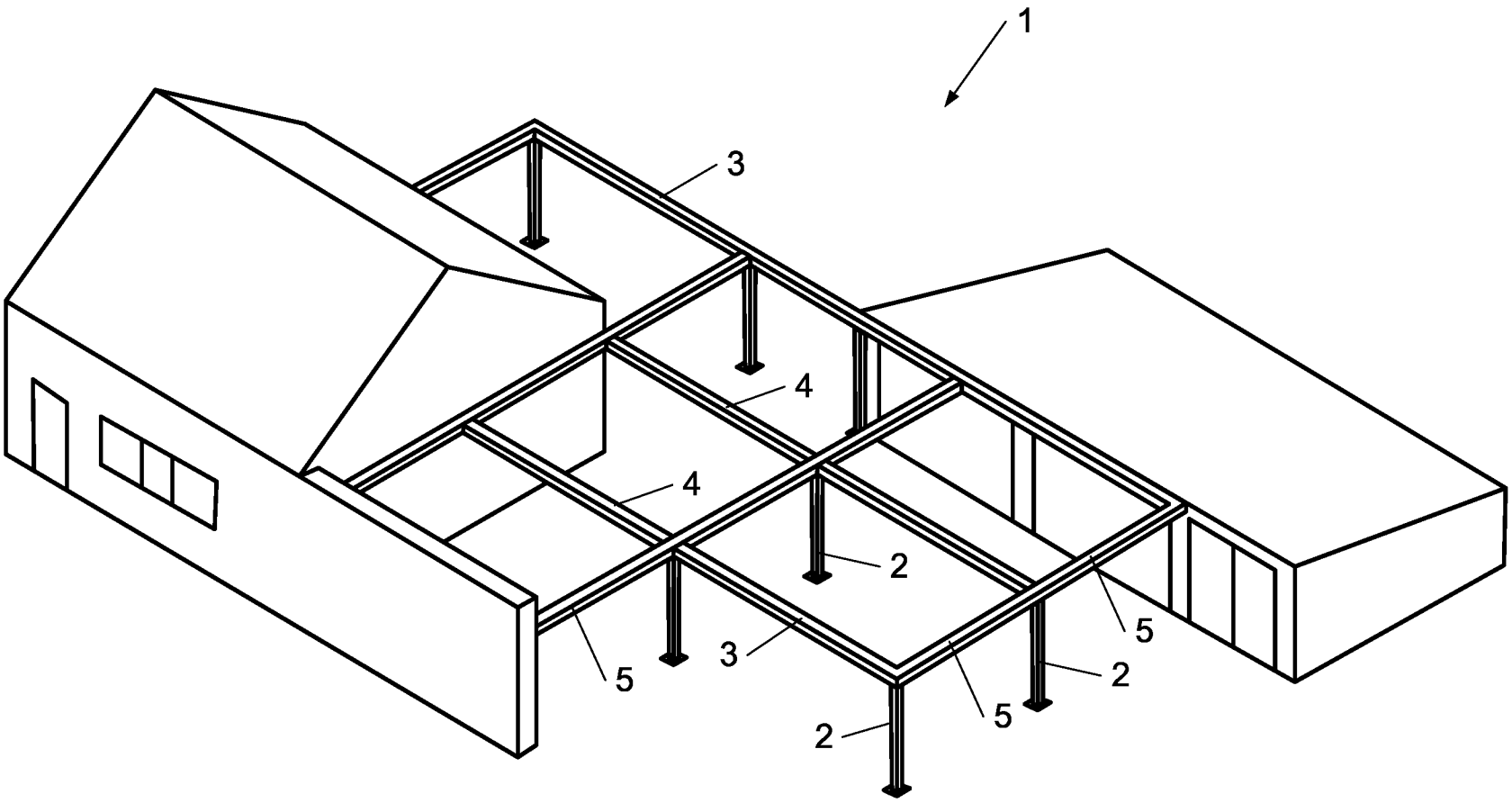
FIG. 1 shows a schematic view of a terrace canopy according to the invention.

The present invention will hereinafter be described using particular embodiments and with reference to certain drawings, but the invention is not limited thereto and is only defined by the claims. The drawings presented here are only schematic representations and are not limiting. In the drawings, the dimensions of certain components may be shown enlarged, which therefore means that the components in question are not shown to scale, and this for illustrative purposes only. The dimensions and relative dimensions do not necessarily correspond to the actual practical embodiments of the invention.

In addition, terms such as "first", "second", "third", and the like are used in the description and in the claims to distinguish between similar elements and not necessarily to indicate a sequential or chronological order. The terms in question are interchangeable under appropriate circumstances, and the embodiments of the invention may operate in other sequences than those described or illustrated herein.

The term "comprising" and derivative terms, as used in the claims, should not be construed as being limited to the means stated thereafter; the term does not exclude other elements or steps. The term should be interpreted as a specification of the mentioned properties, integers, steps, or components referenced, without excluding the presence or addition of one or more additional properties, integers, steps, or components, or groups thereof. The scope of an expression such as "a device comprising the means A and B" is therefore not limited only to devices consisting purely of components A and B. On the other hand, what is intended is that, for the purpose of the present invention, the only relevant components are A and B.

Figure 3A:
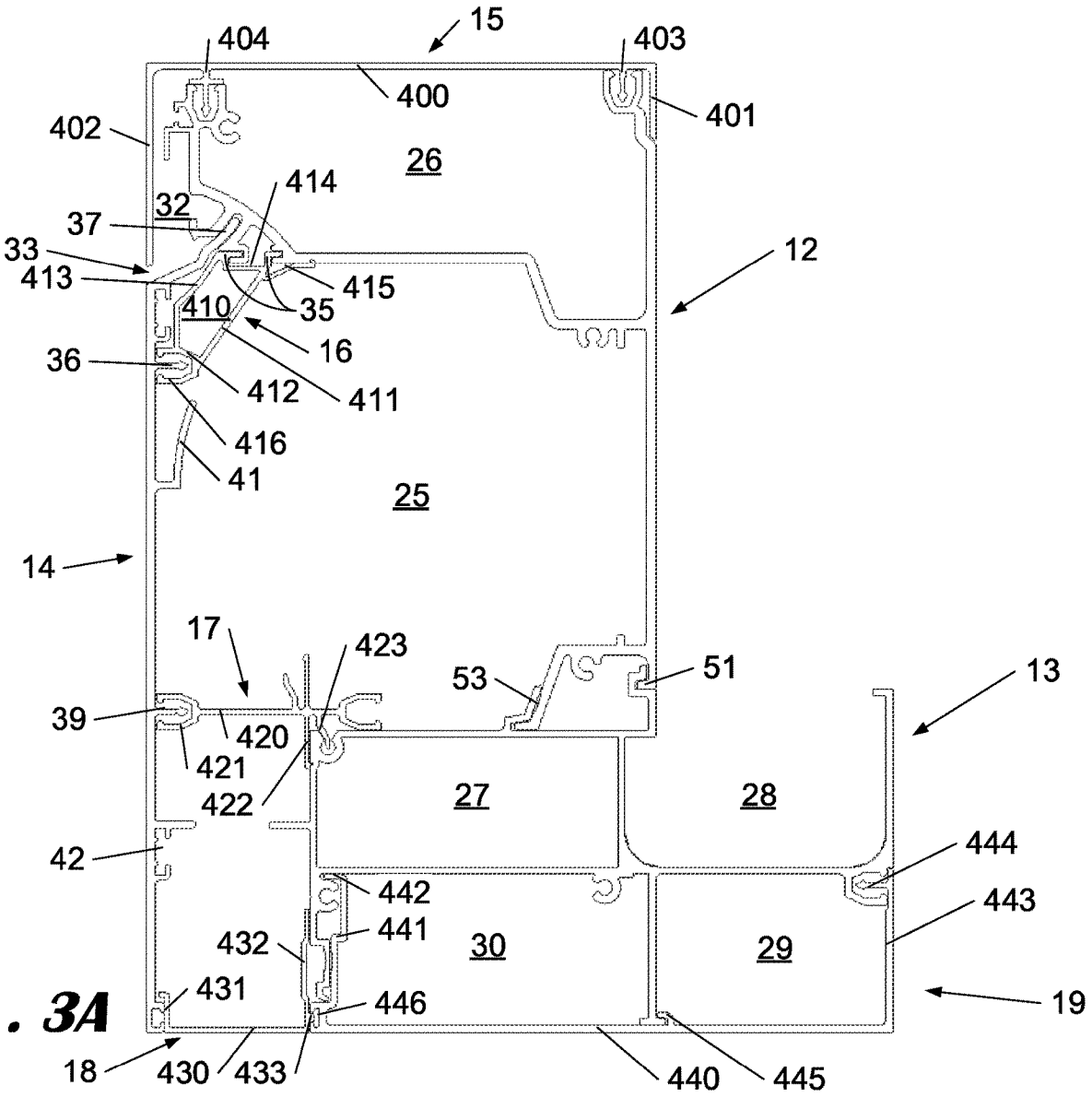
FIGS. 3A to 3K each show a section through an alternative embodiment of an external pivot beam with different wall infill functionality.
Figure 3B:
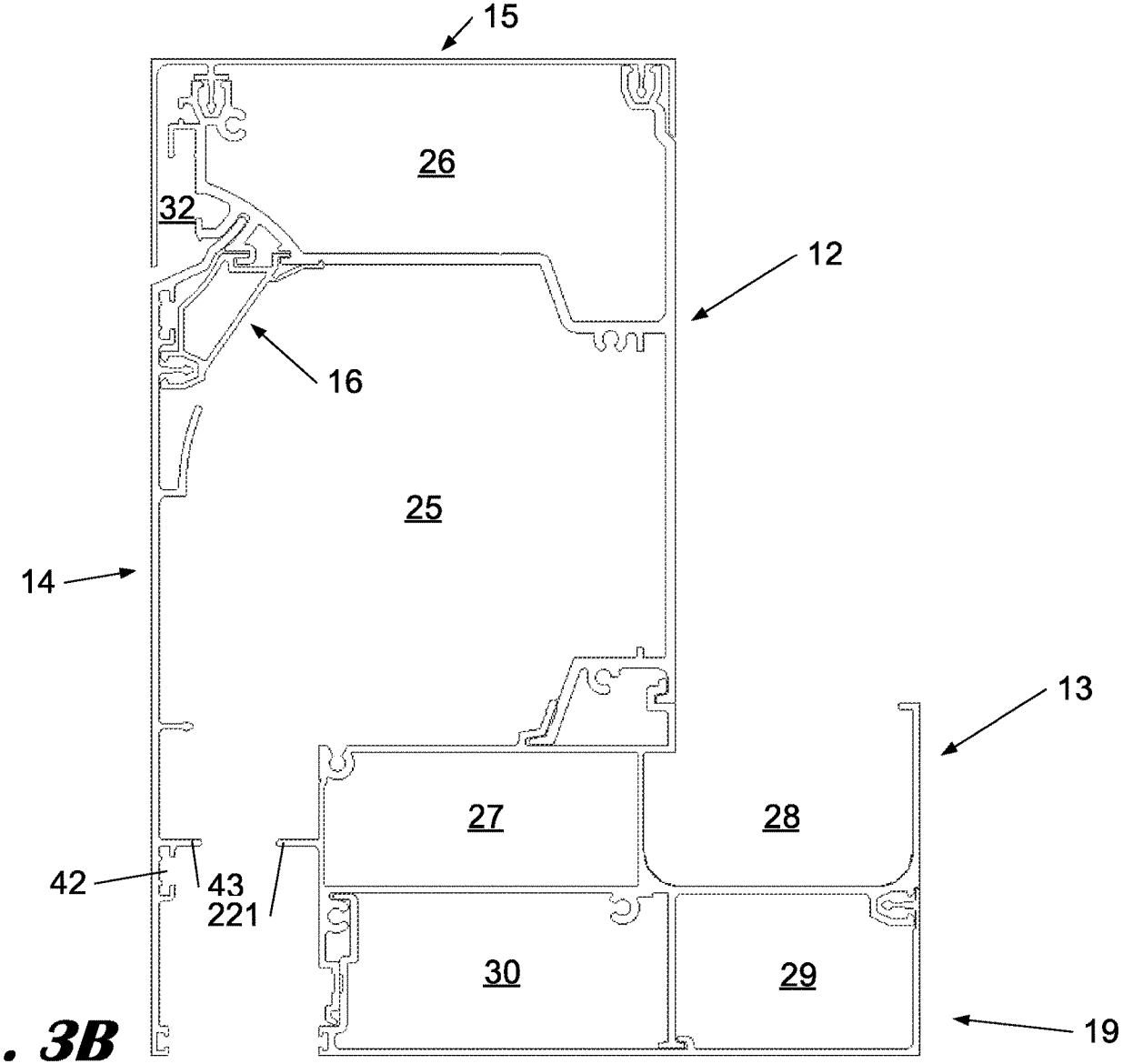
Figure 3C:
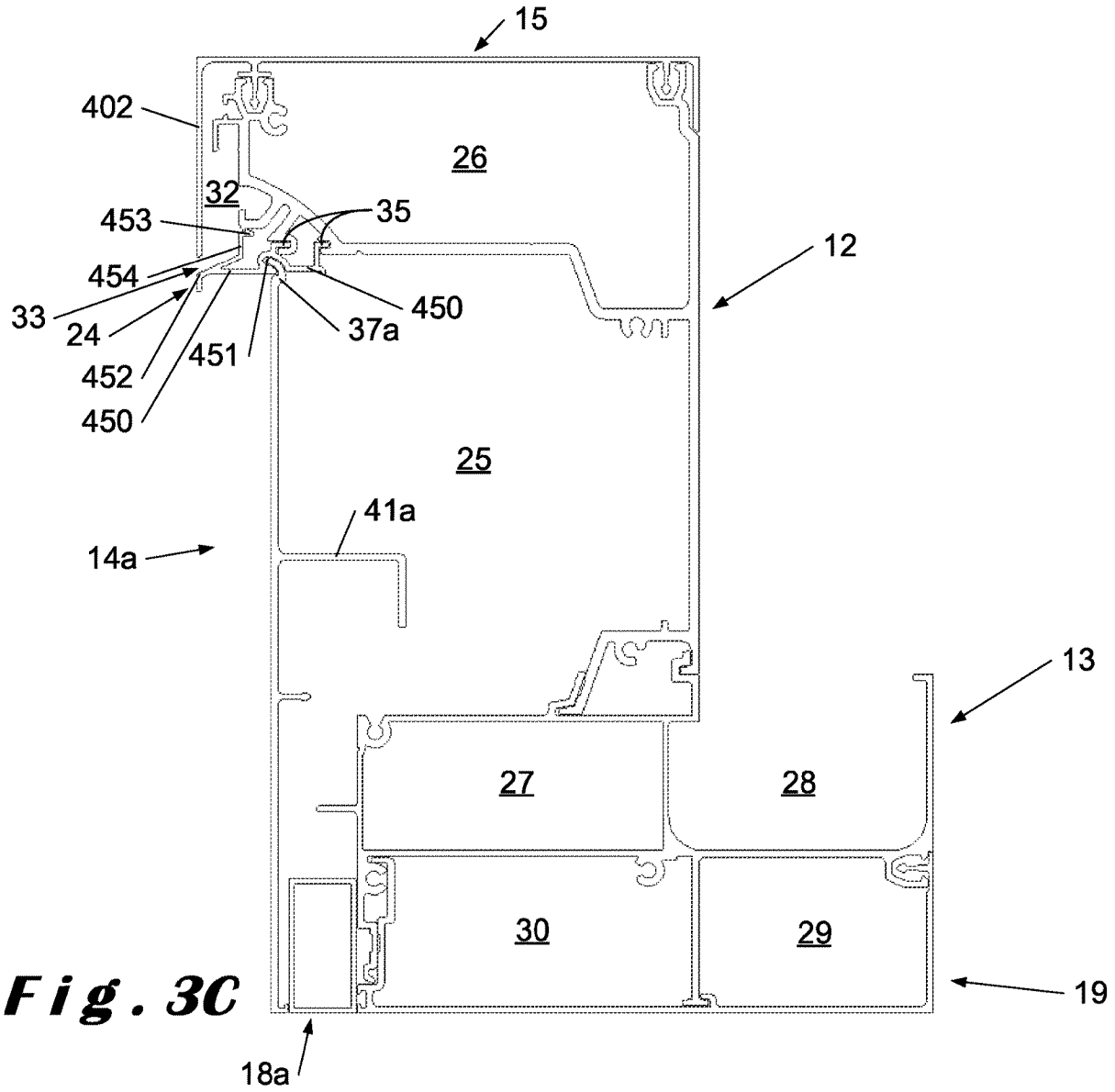
Figure 3D:
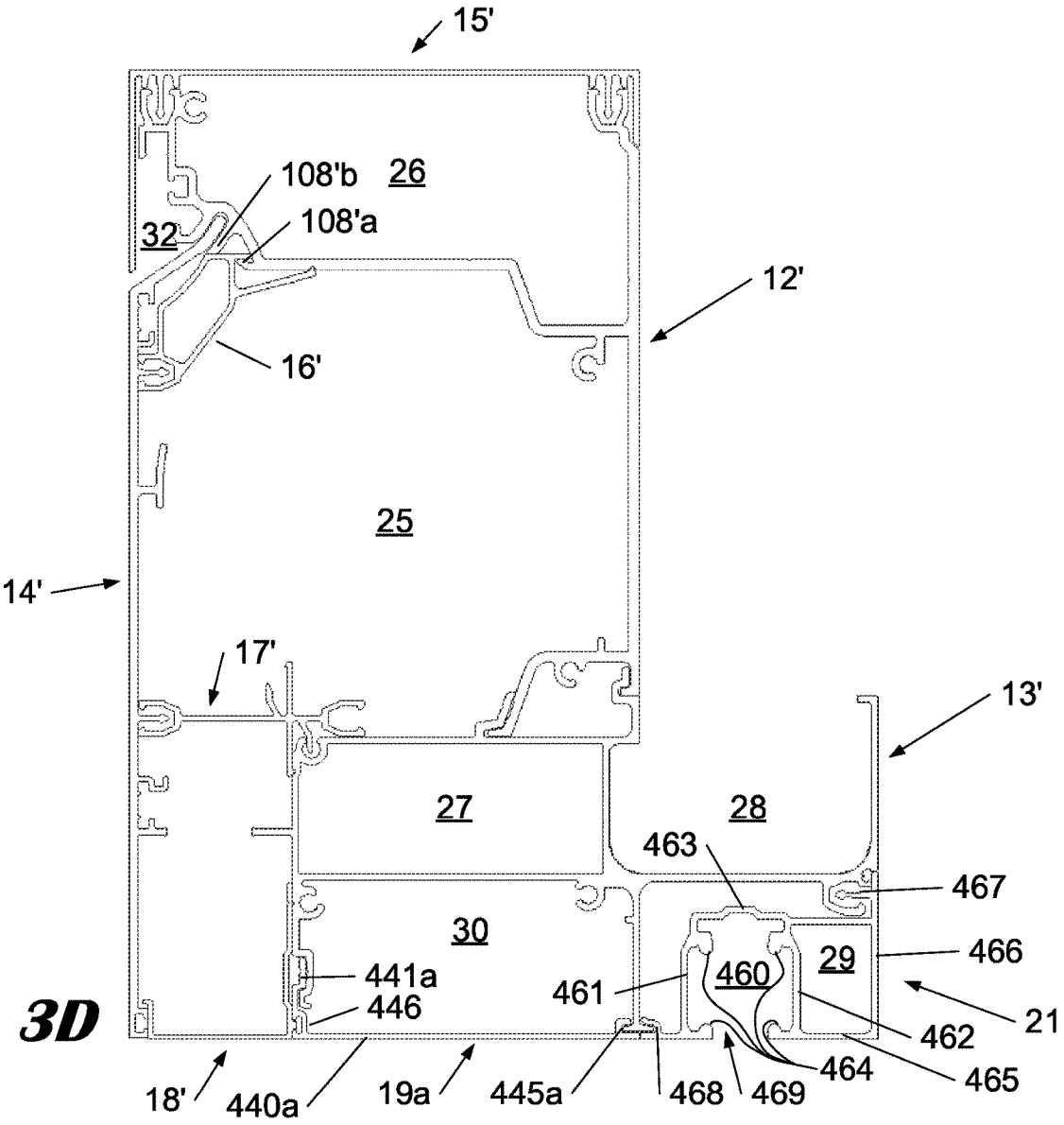
Figure 3E:
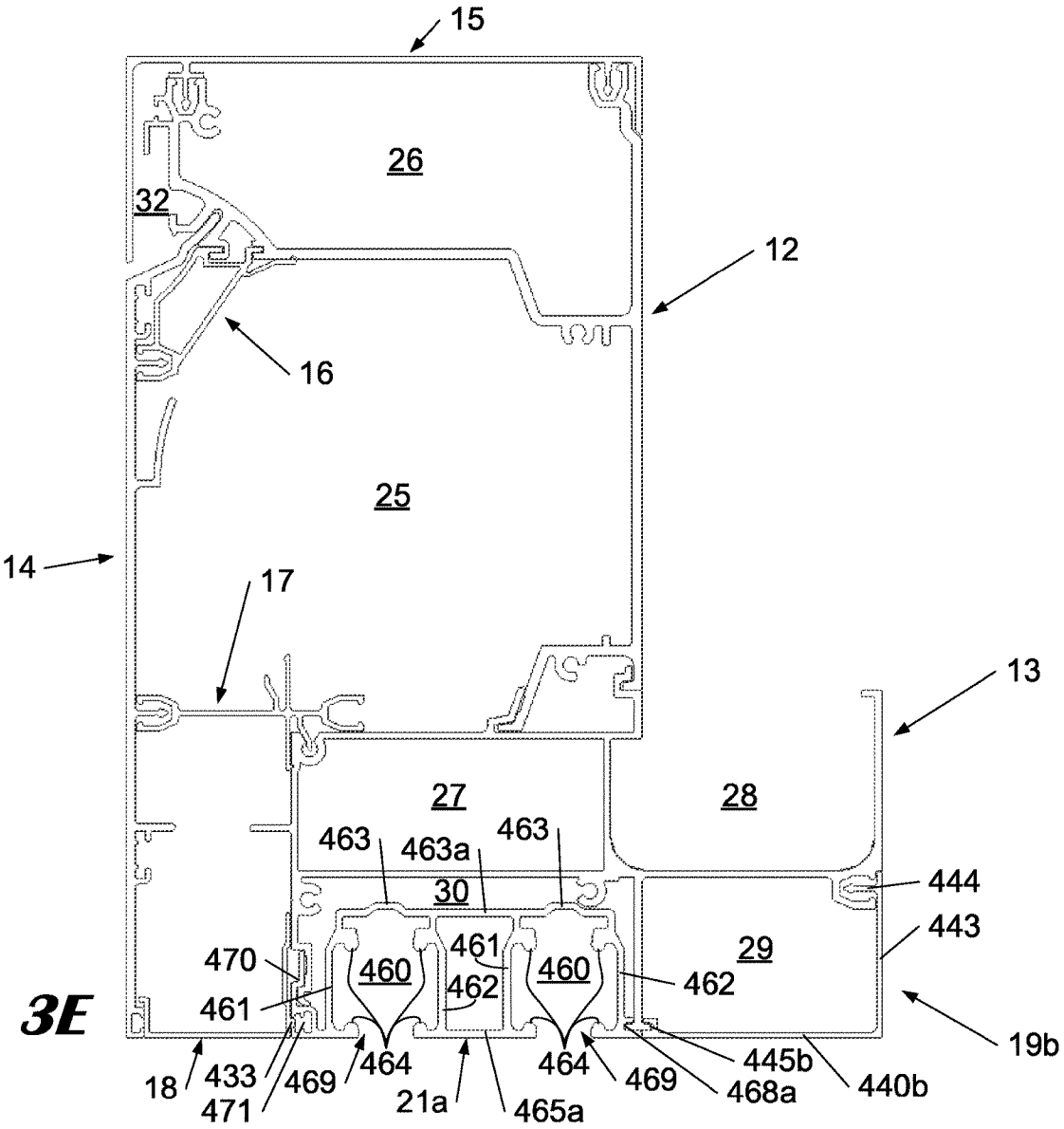
Figure 3F:
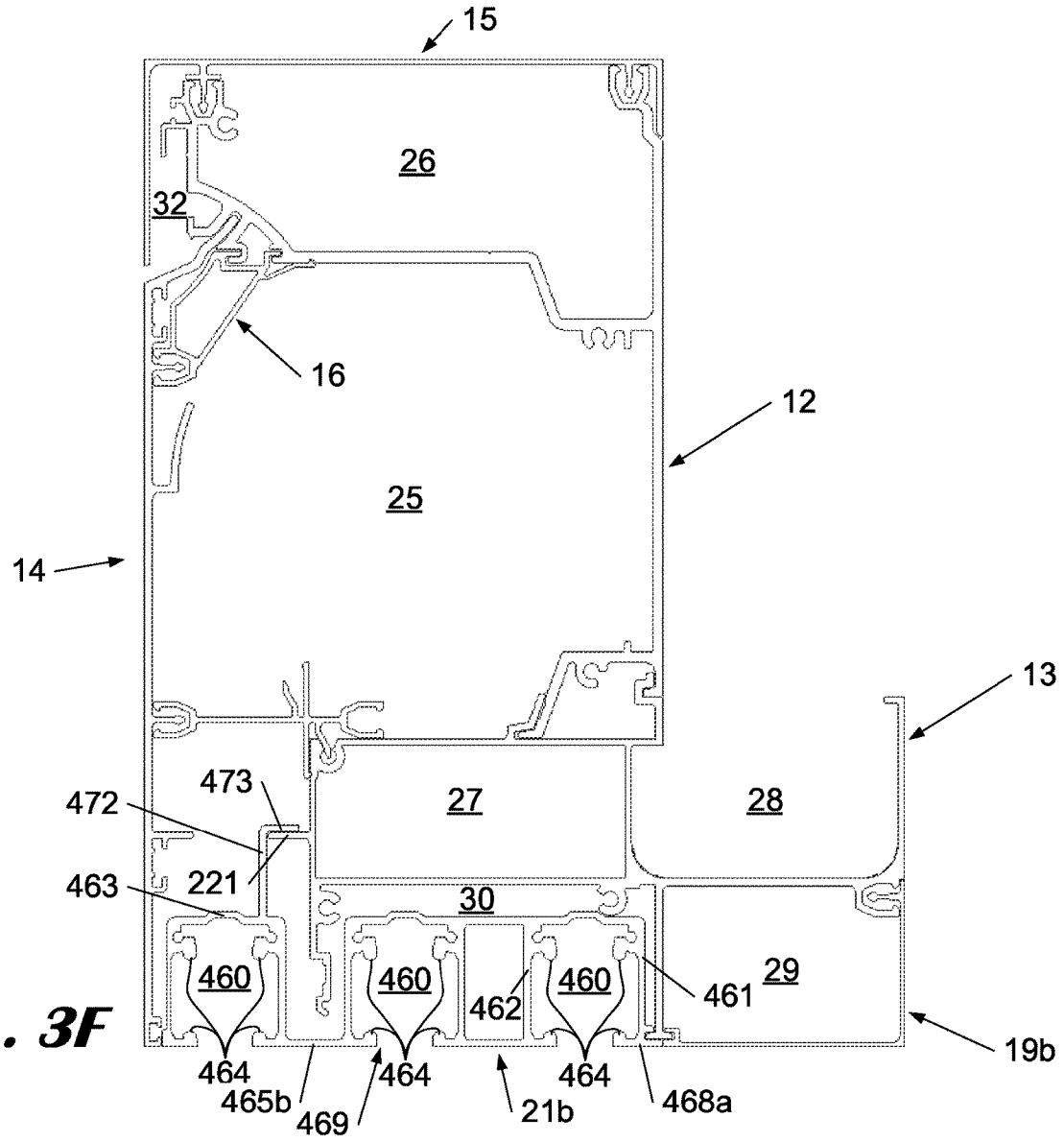
Figure 3G:
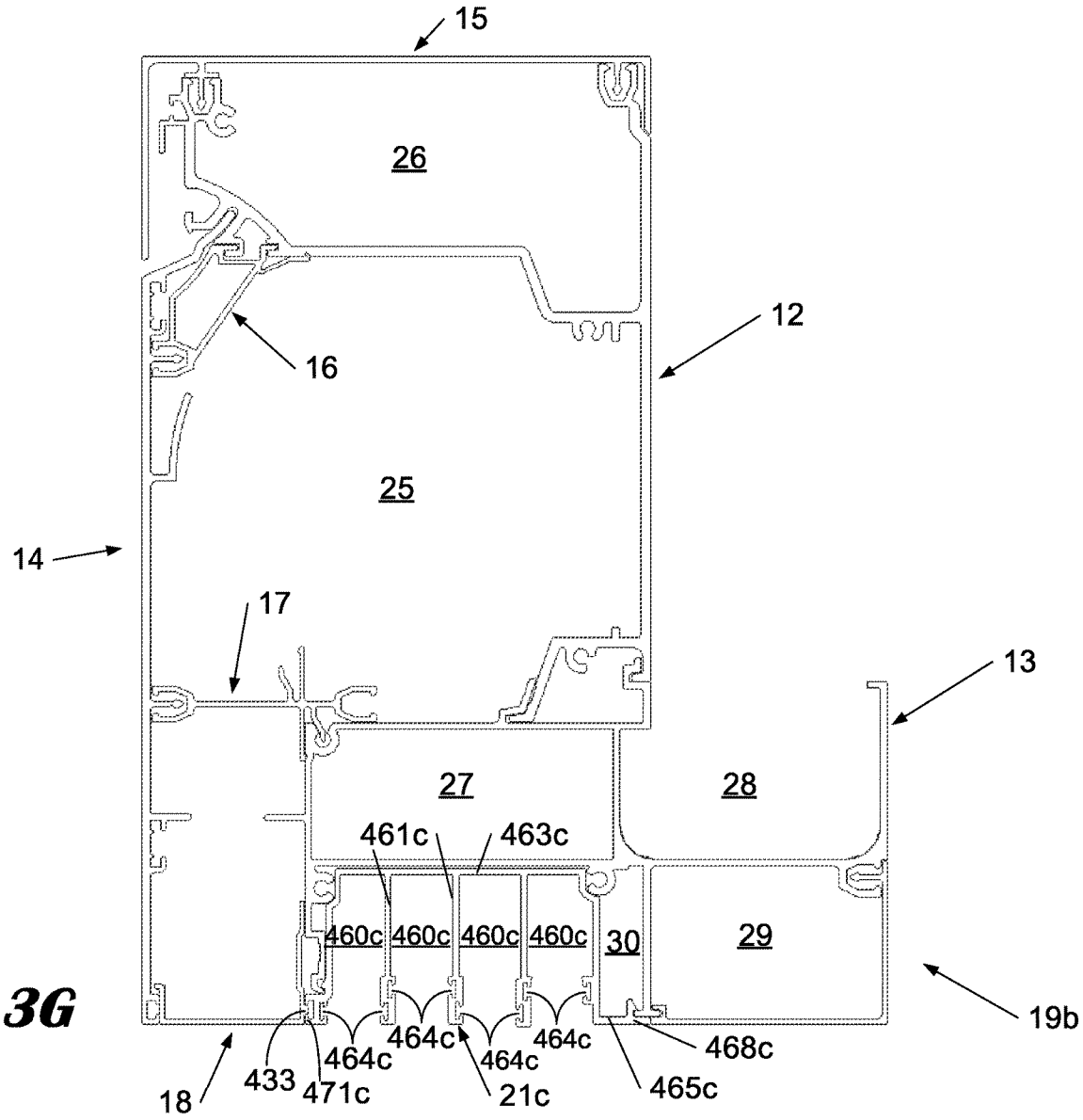
Figure 3H:
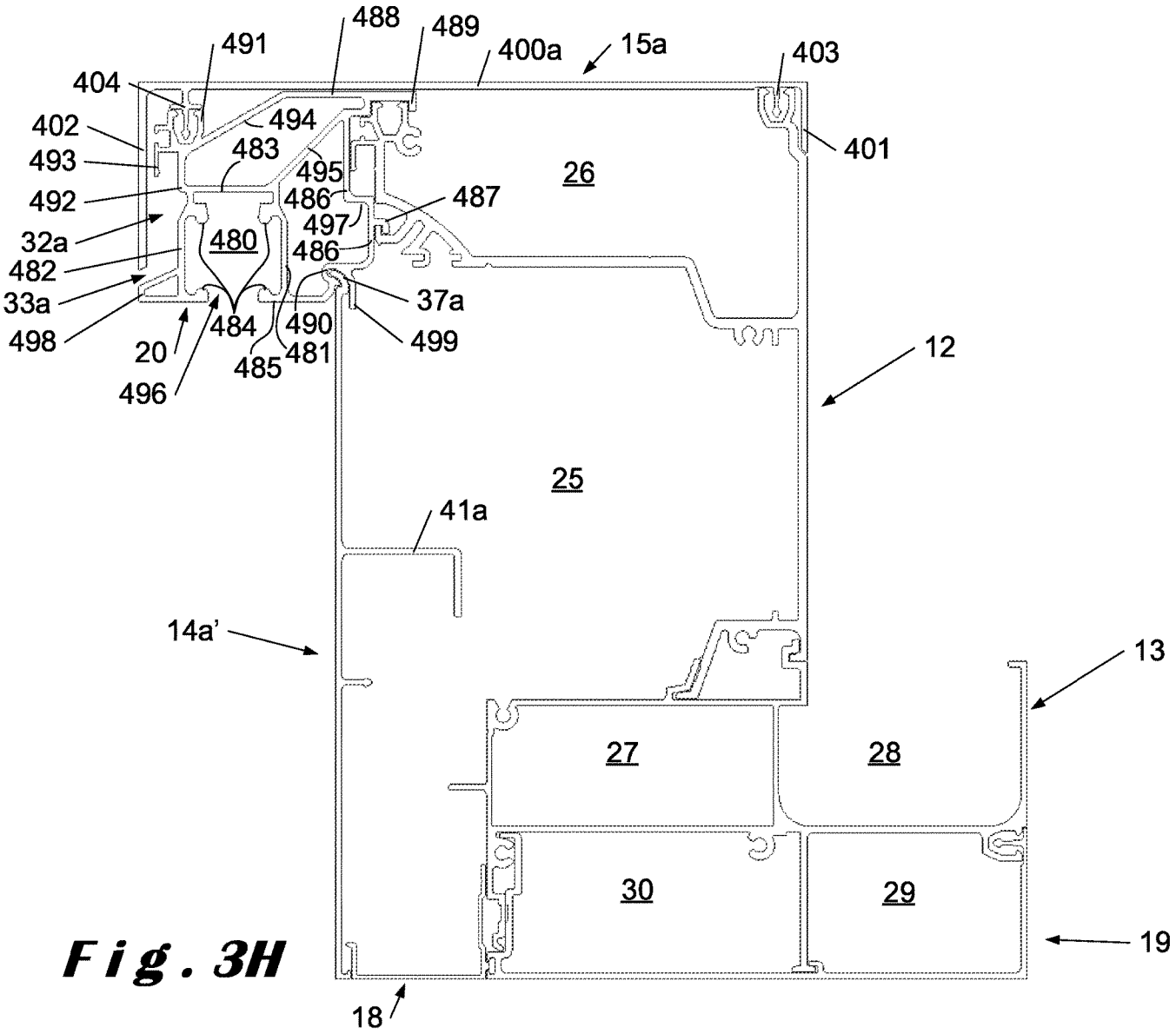
Figure 3I:
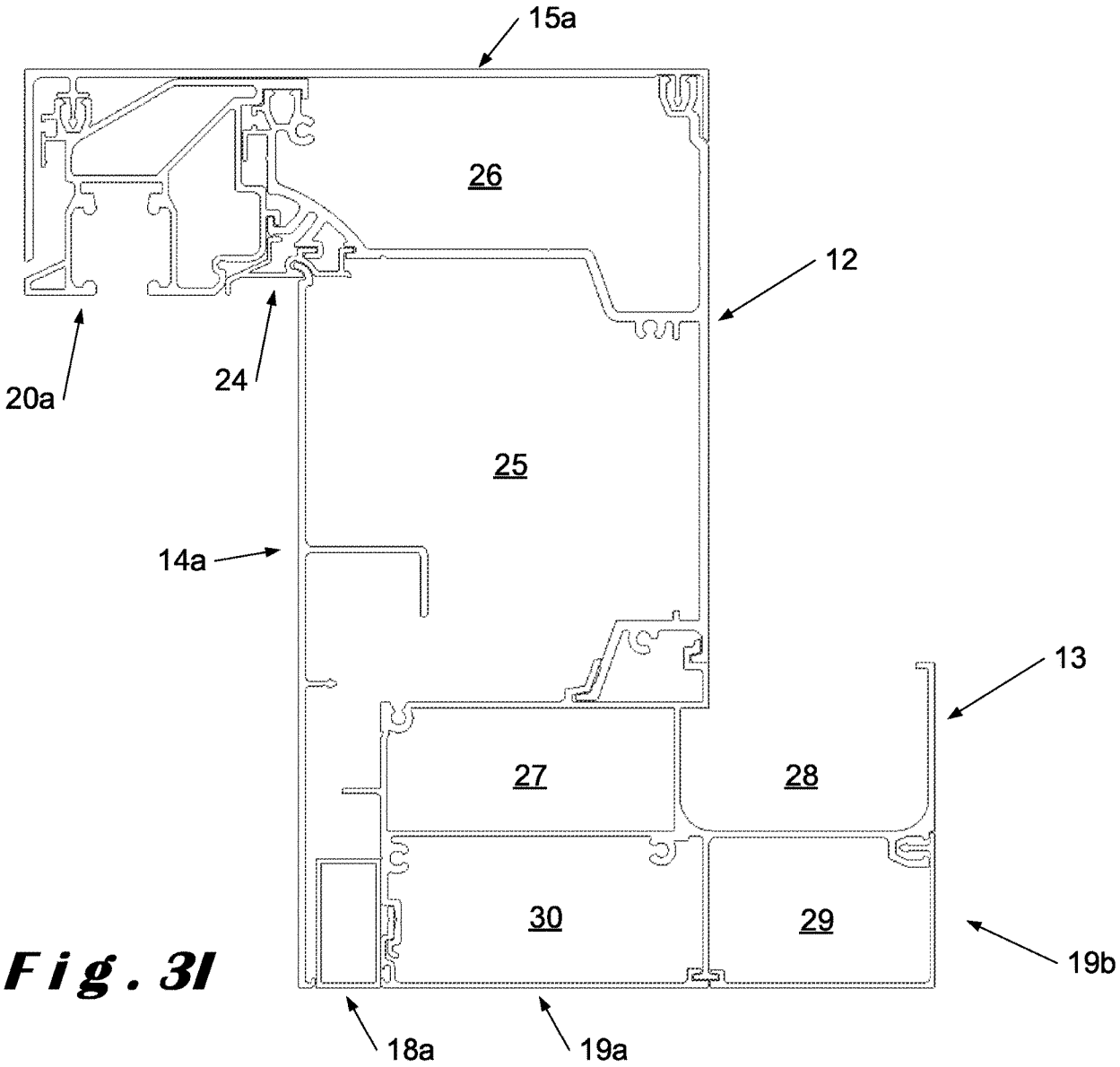
Figure 3J:
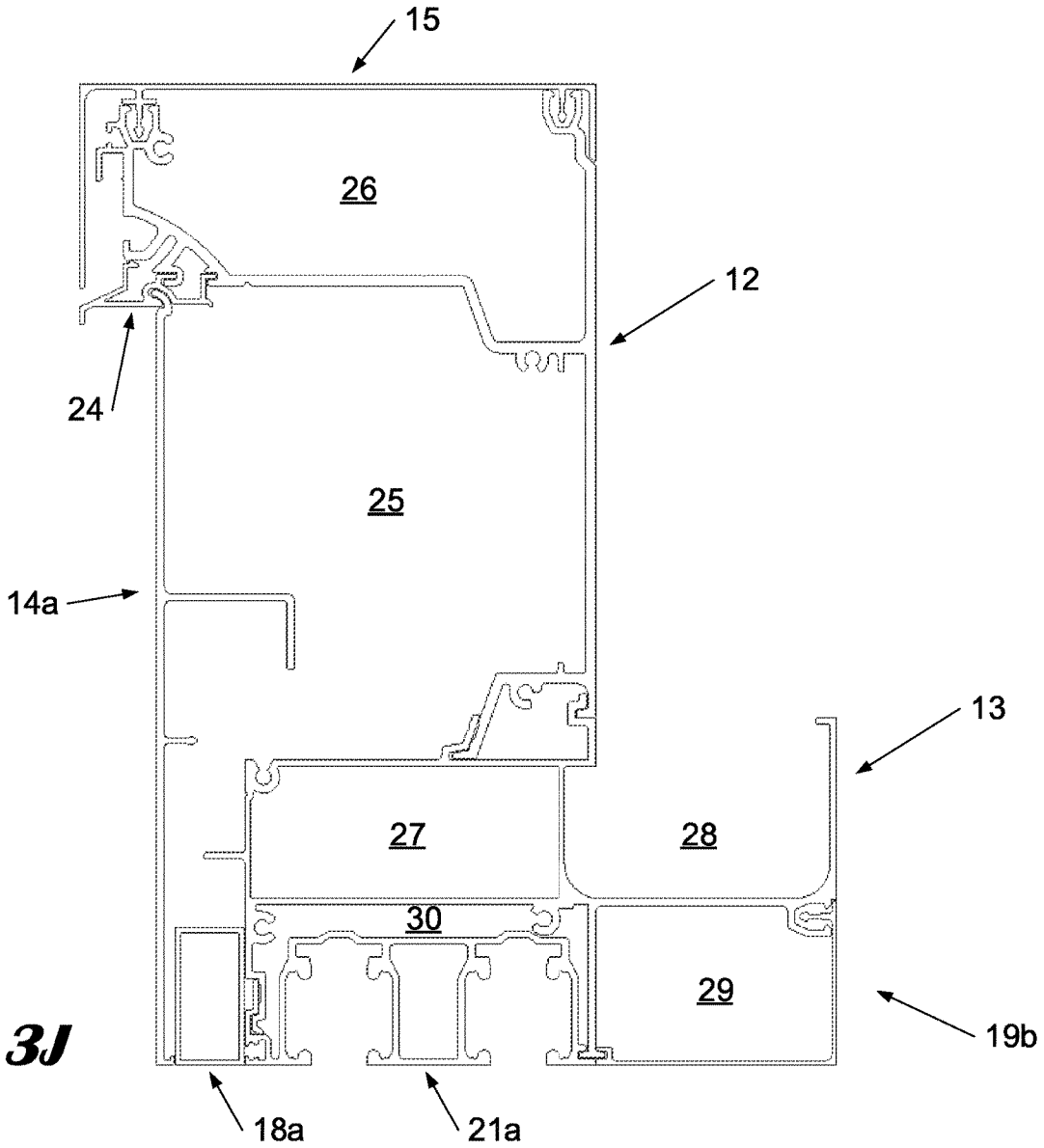
Figure 3K:
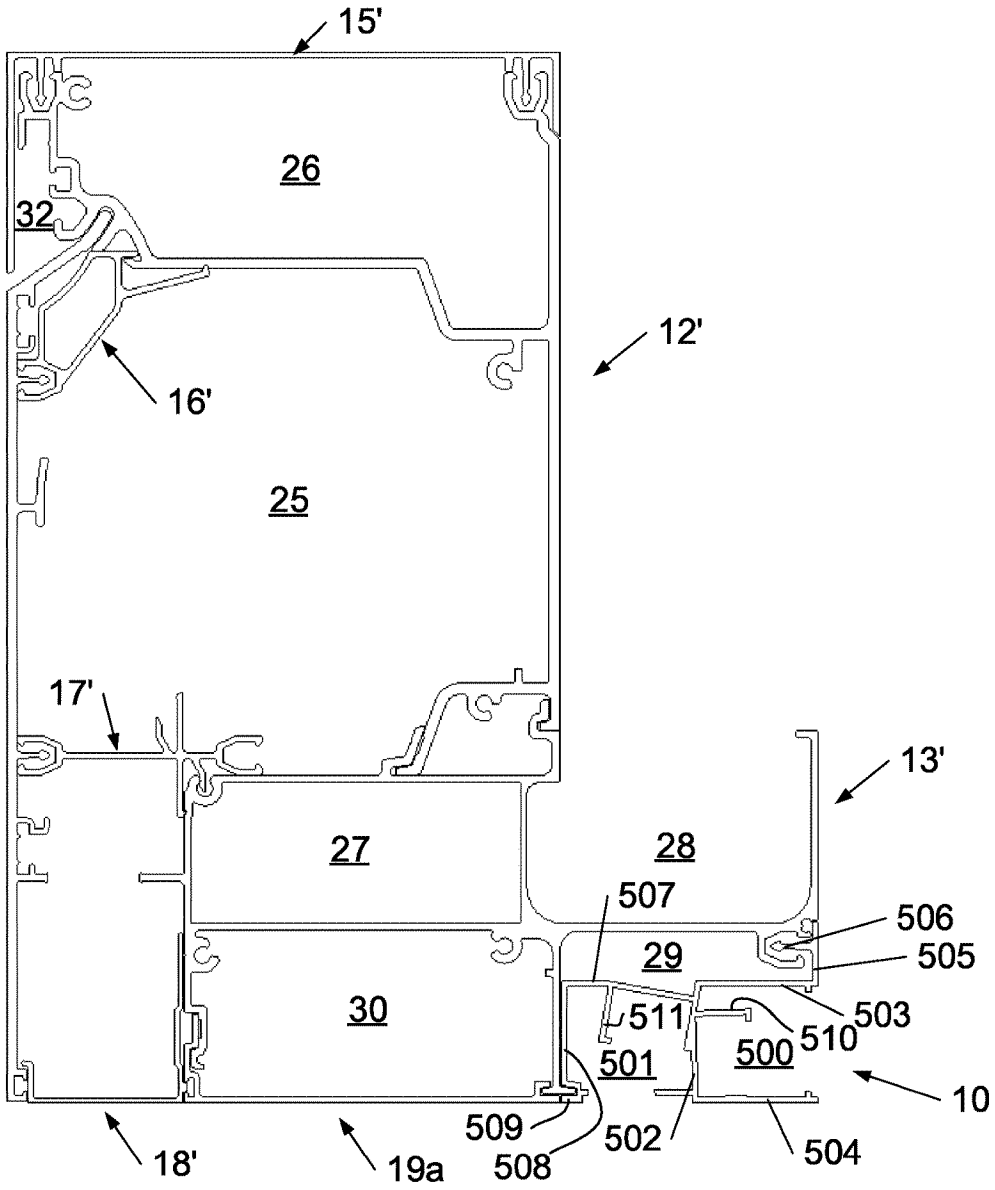
Figure 4:
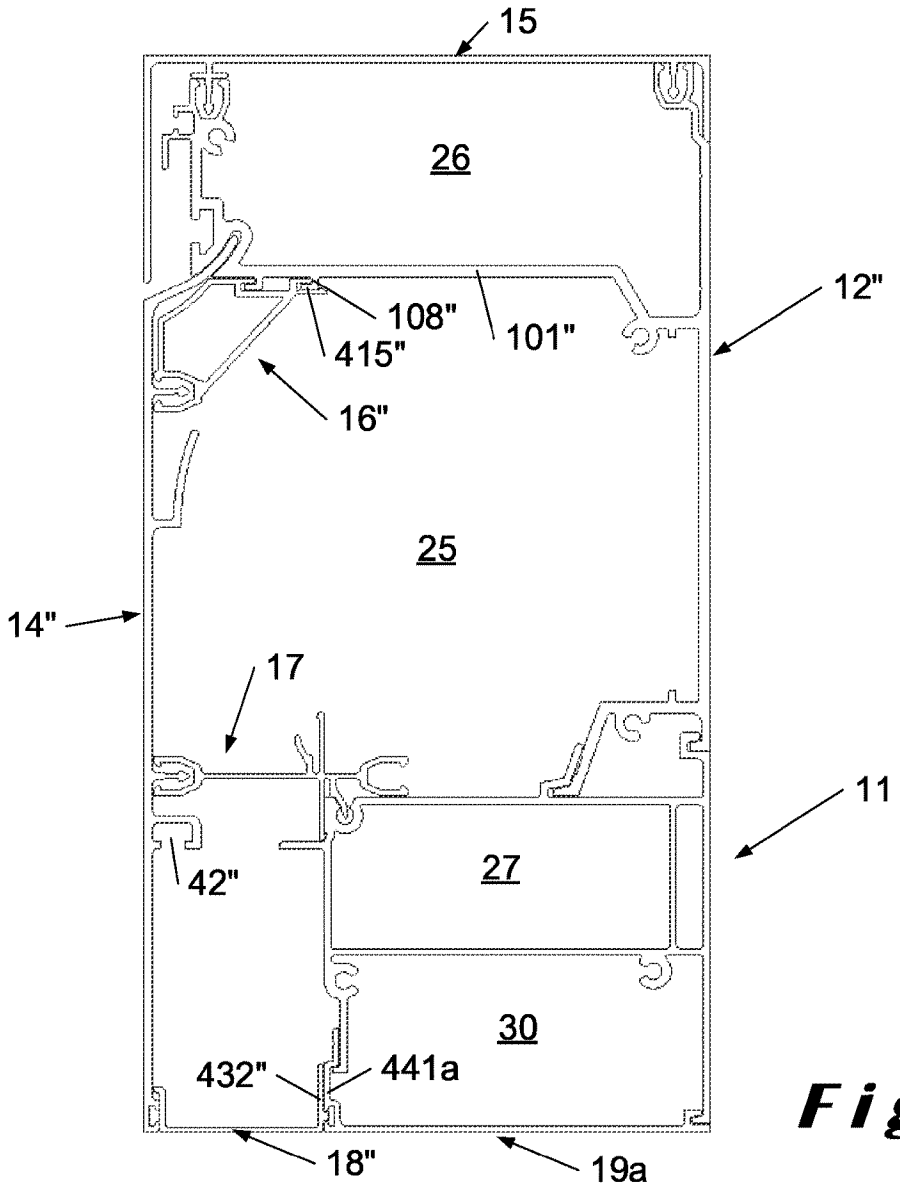
FIG. 4 shows a cross-section through a basic embodiment of a tension beam.

With reference to FIGS. 3, 4 and 6, each reference to an orientation of the beams will be interpreted with reference to the position when mounted in the terrace canopy. In this way there are four orientations, namely above, below, outer side and inner side. Here, "above" refers to the part of the beam that is or will be oriented towards the top surface (the sky, e.g. the open sky), "below" refers to the part of the beam that is or will be oriented towards the ground plane (the soil, e.g. the terrace floor), "outer side" to the part of the beam that is or will be oriented away from the roof, i.e. away from the roof infill (i.e. the left side in FIGS. 3, 4 and 6) and "inner side" to the part of the beam that is or will be oriented towards the inner side of the roof, i.e. towards the roof infill (i.e. the right side in FIGS. 3, 4 and 6).

The term "substantially" includes variations of +/−10% or less, preferably +/−5% or less, more preferably +/−1% or less, and more preferably +/−0.1% or less, of the specified state, insofar as the variations are applicable to function in the disclosed invention. It is to be understood that the term "substantially A" is intended to also include "A".

FIG. 1 illustrates a terrace canopy 1 for a ground surface, for example a terrace or garden. The terrace canopy comprises a plurality of columns 2 that support different beams 3, 4, 5. The columns and beams together form frames to which wall infills 6 and/or roof coverings 7 can be attached as described hereafter. The terrace canopy 1 comprises three types of beams 3, 4, 5, namely:

a beam 3 which, on the outside of the terrace canopy 1, serves as an external pivot beam 3;

a beam 4 which, centrally in the terrace canopy 1, serves as a central pivot beam 4; and a beam 5 which serves as a tension beam 5.

It will also be appreciated that the beams 3, 4, 5 may be attached to other structures, for example a wall or facade, instead of resting solely on columns 2 as shown in FIG. 1. In such a way, the terrace canopy 1 can generally be used to shield an outdoor space, as well as an indoor space.

FIGS. 2A to 2J show terrace canopies 1 with alternative wall infills 6. The terrace canopies 1 shown have in common that four support columns 2 are provided which support a frame, also called a roof frame. The frame is formed from two external pivot beams 3 and two tension beams 5 in between a roof covering 7 is provided.

In the embodiments shown, the roof covering 7 is formed by slats which are rotatably attached at their front ends to pivot beams 3. The slats are rotatable between an open position and a closed position. In the open position, there is an intermediate space between the slats through which, for example, air can be introduced into the underlying space or can leave this underlying space. In the closed position, the slats form a closed roof with which the underlying space can be shielded from, for example, wind and/or precipitation, such as rain, hail or snow. For the drainage of precipitation, the slats are typically arranged sloping towards one of both pivot beams 3.

The slats are typically manufactured of a rigid material. This can be aluminium, for example. Aluminium has many advantages as a material, as it is at the same time robust and light-weighted, it can withstand bad weather conditions and requires little maintenance. However, other materials are also suitable and their advantages or disadvantages are assumed to be known by the skilled person. A slat can be produced using various techniques depending on the material, including extrusion, cutting, setting, casting, welding, etc. The appropriate production technique is assumed to be known by the skilled person. Preferably, the slats are manufactured by means of an extrusion process. Optionally, filling elements of, for example, polycarbonate, glass, wood, etc. can be used to fill the hollow slats at least partially, for instance to obtain a different appearance of the slat.

Additionally, in an embodiment, in their open position, the slats may optionally be provided slidable in the terrace canopy 1, in order to further increase the control options in terms of incidence of light, radiant heat and ventilation.

More generally, the roof covering 7 is stationary or movable. A movable roof covering comprises, for example, tiltable and/or slidable slats (such as described above) and/or roll-in/roll-out screens and/or slidable panels. The individual elements of the movable roof covering 7 in their closed position form a substantially watertight roof with which the underlying space can be screened off from, for instance, wind and/or precipitation, such as rain, hail or snow. This roof covering 7 is typically drained to the pivot beams 3, 4 and from there directly or via the tension beams 5 to the columns 2. By sliding and/or rotating the slats and/or the panels and/or by rolling in a screen, the roof covering 7 can be at least partially opened and/or closed in order to be able to determine the incidence of light, radiant heat, ventilation, precipitation, etc. to the space below the roof covering 7 as desired.

Wall infills 6 are typically intended to screen openings below the terrace canopy 1 between the columns 2. The wall infills 6 can be stationary or movable. Movable side walls comprise, for example, roll-in/roll-out screens and/or wall elements that are slidably arranged with respect to each other, etc. Stationary side walls can be manufactured of various materials, such as plastic, glass, metal, textile, wood, etc. Combinations of different wall infills 6 are also possible.

Figure 2A:
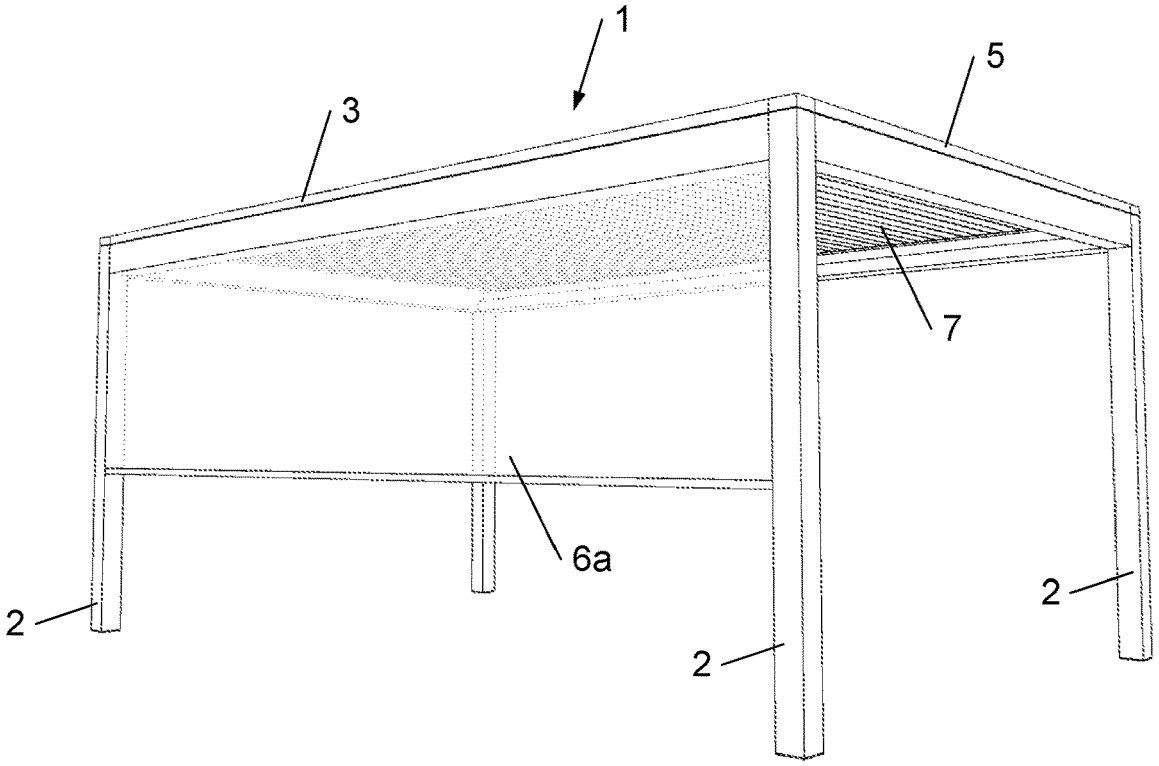
FIGS. 2A to 2J show alternative embodiments of the terrace canopy with different wall infills.

FIG. 2A illustrates a wall infill in the form of a roll-in/roll-out screen 6*a*. The screen 6*a* extends between two adjacent columns 2 and can be rolled out from the external pivot beam 3. The screen 6*a* mainly serves as a wind and/or sun screen.

Figure 2B:
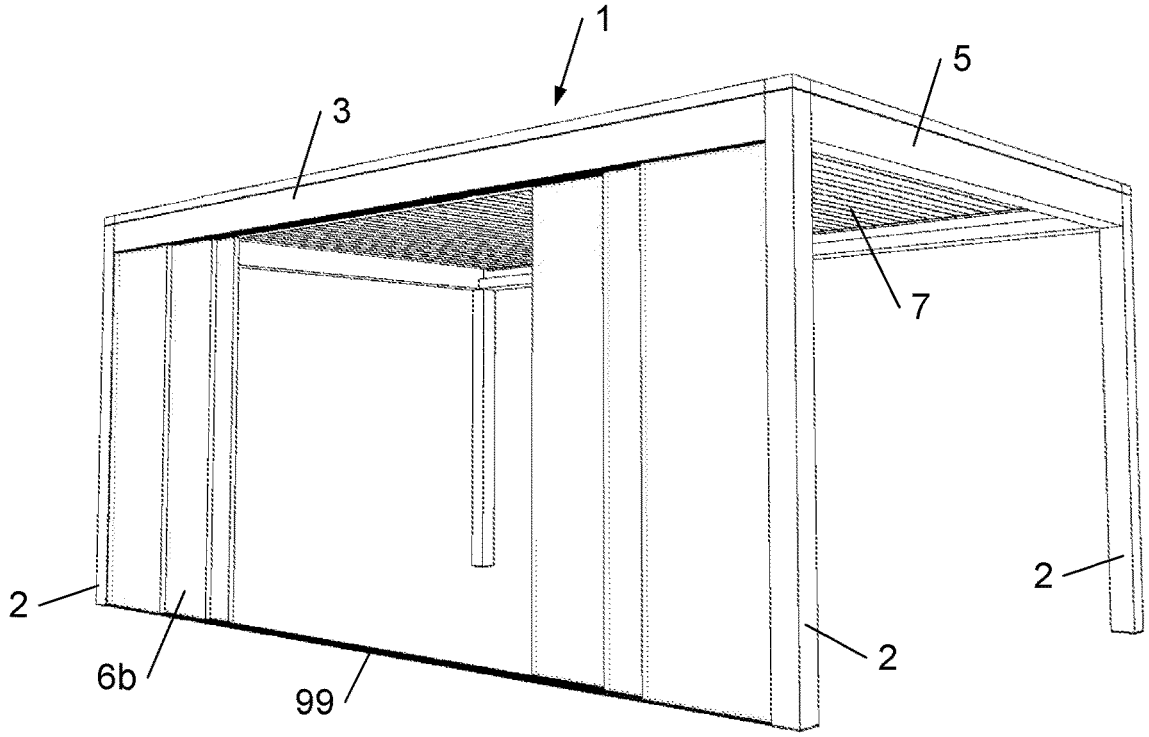
Figure 2C:
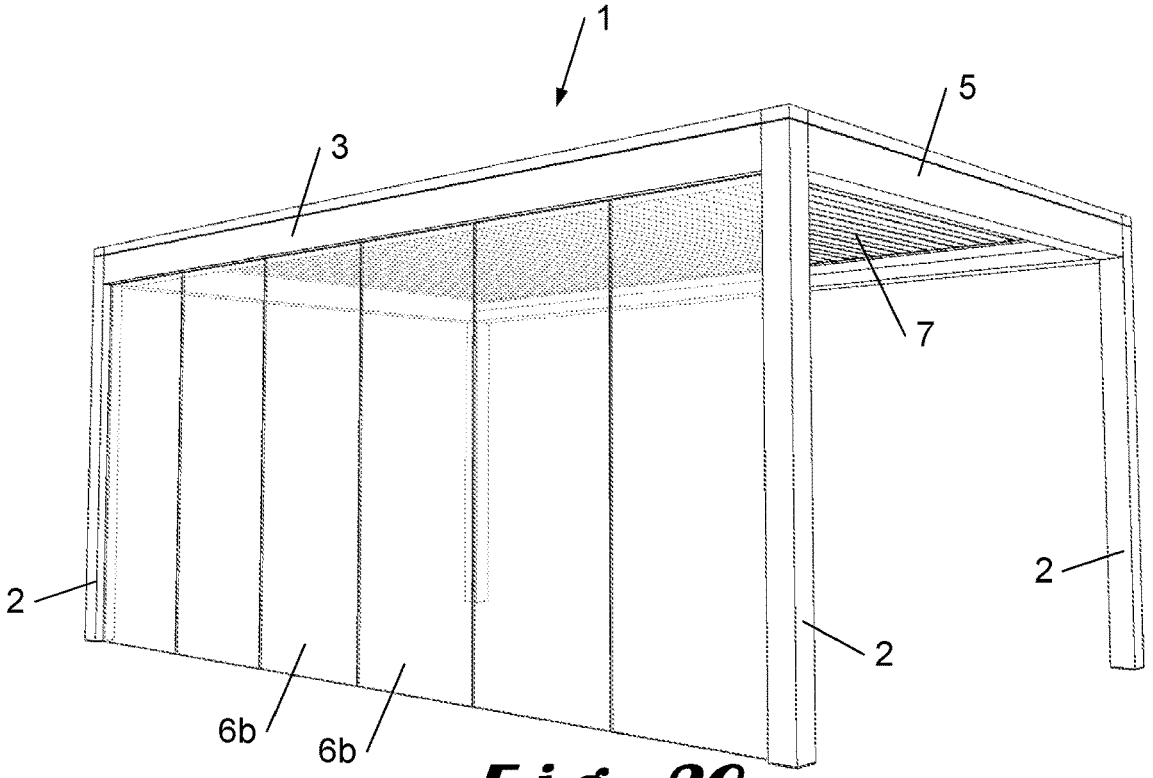
Figure 2D:
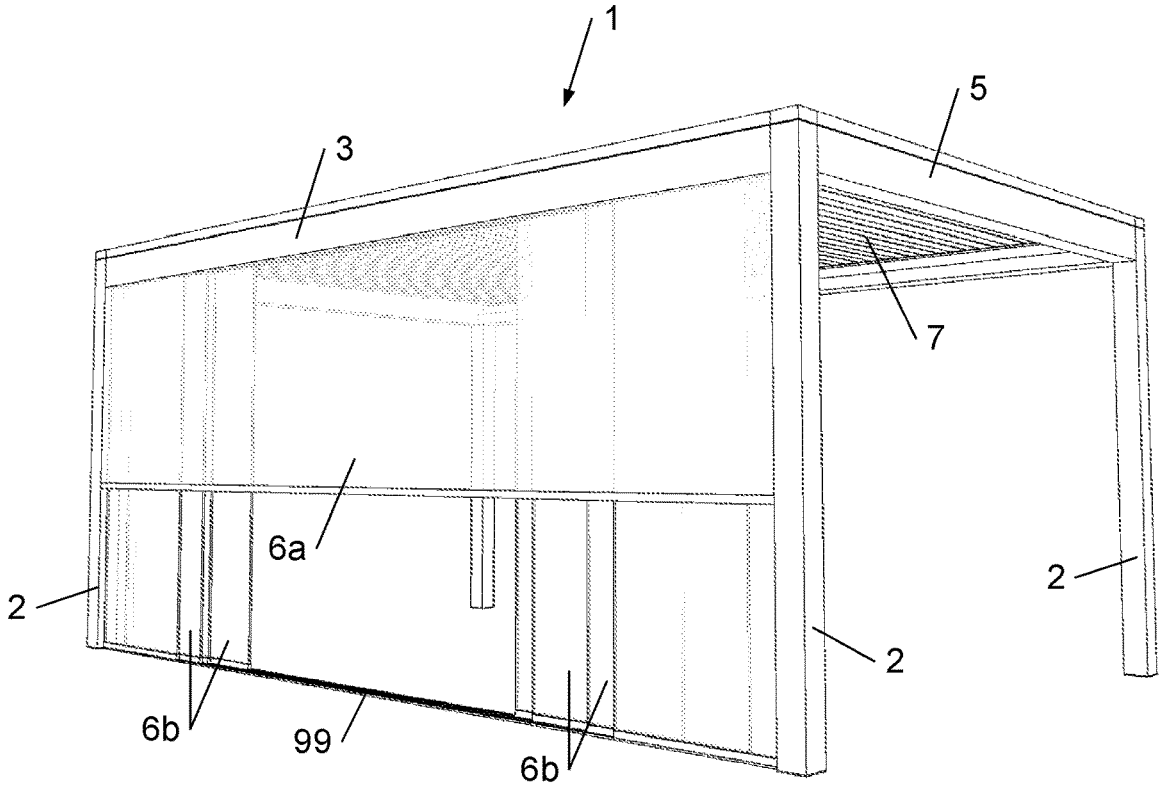

FIG. 2B illustrates a wall infill in the form of sliding wall panels 6*b*. In the embodiment shown, three panels 6*b* are provided on either side of the wall. The panels 6*b* are slidable in pairs (namely one on either side) in a rail provided for this purpose in the external pivot beam 3. On the ground, also a guide 99 is provided for the wall panels 6*b*, but this guide 99 is optional. FIG. 2C illustrates the terrace canopy 1 of FIG. 2B with the wall panels 6*b* in their closed position. The wall panels 6*b* are transparent and preferably made of glass. Naturally, non-transparent wall panels 6*b* are also possible. Their function is mainly wind and water protection, but depending on their material, sun protection is also possible. A combination of the wall infills of FIGS. 2A to 2C is shown in FIG. 2D. There, a double wall infill is provided, which, on the one hand, comprises a roll-in/roll-out screen 6*a* and, on the other hand, slidable wall panels 6*b* (in this case four panels 6*b* on either side).

Figure 2E:
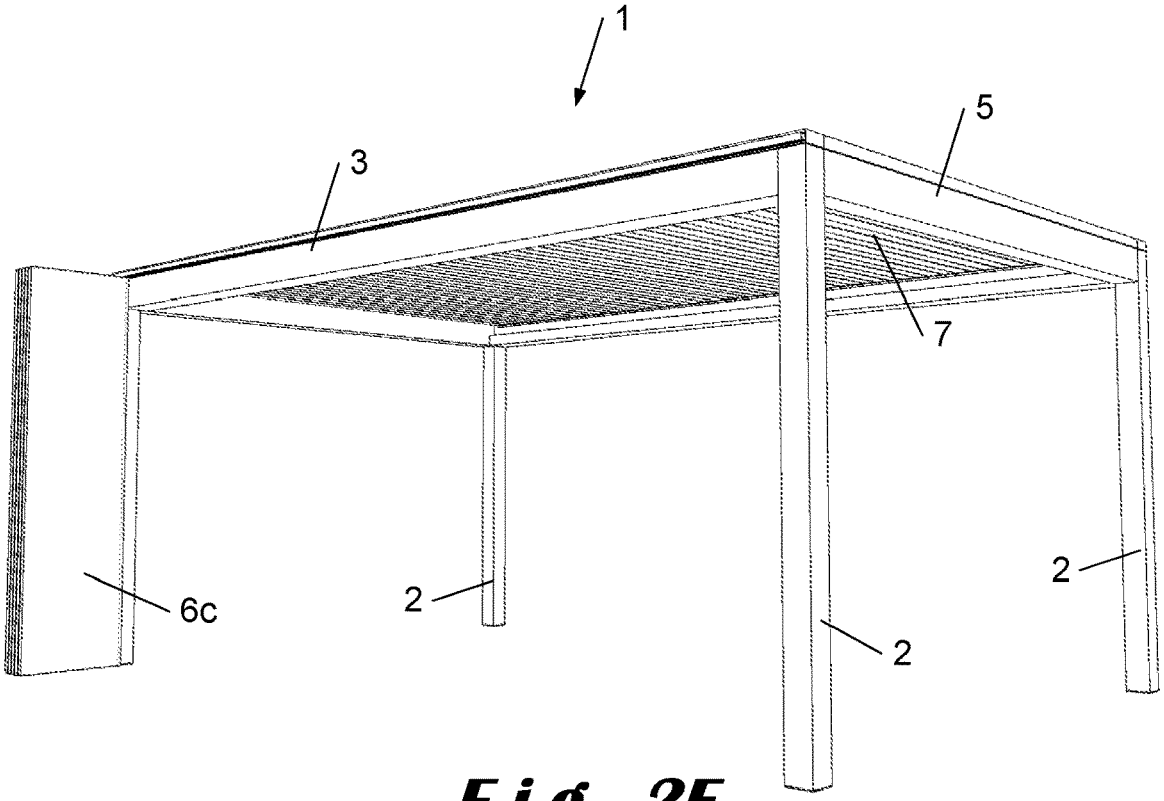
Figure 2F:
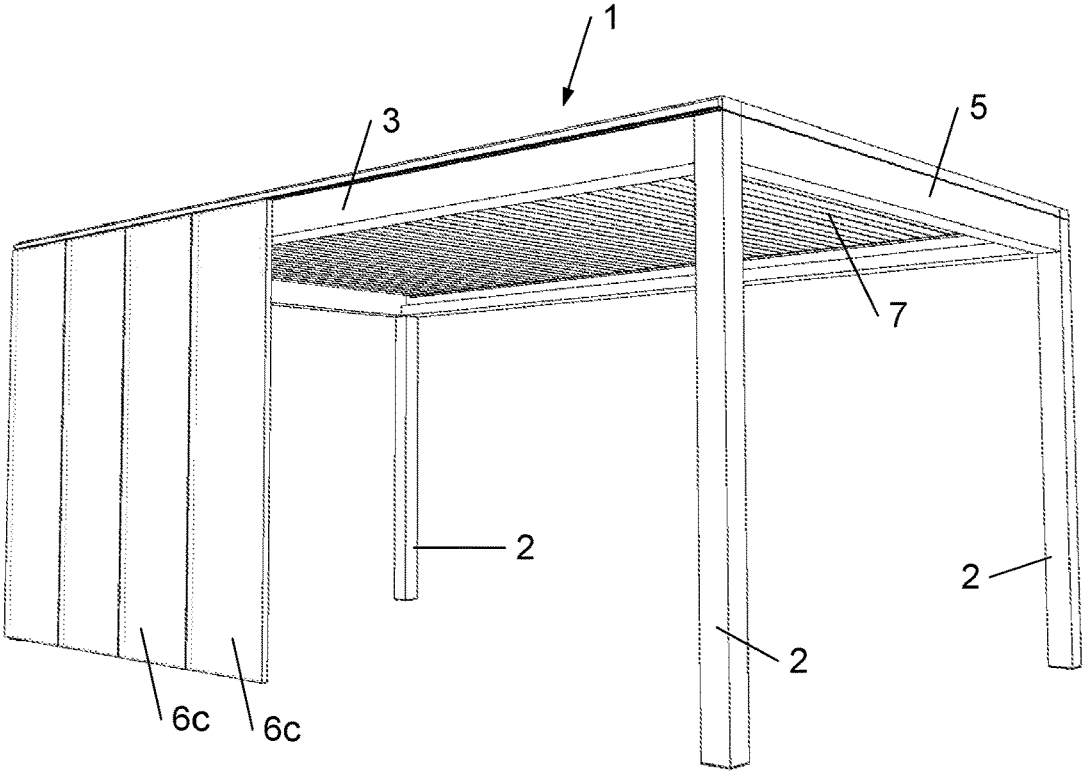
Figure 2G:
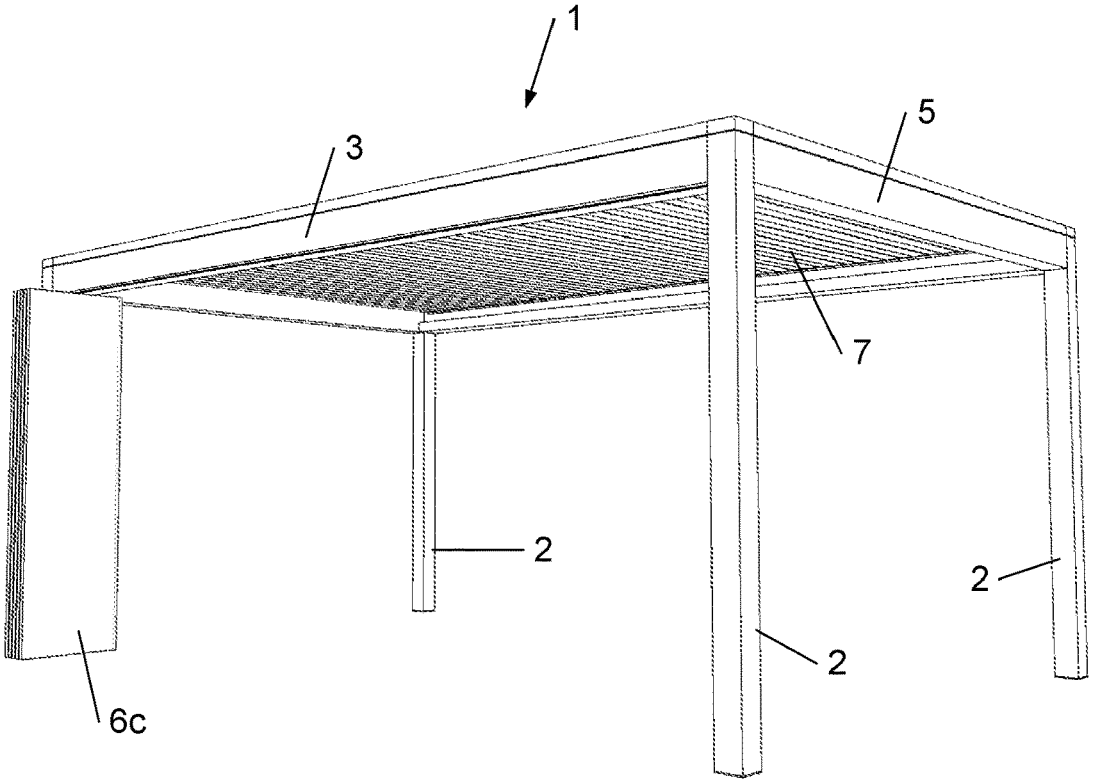

Another type of wall infill is shown in FIGS. 2E and 2F. The wall infill comprises foldable wall panels 6*c*. The wall panels 6*c* are foldable towards the column 2. FIG. 2F illustrates the terrace canopy 1 of FIG. 2E with the wall panels 6*c* in their closed position. Additional wall panels 6*c* are required to cover the entire wall between the columns 2. The wall panels 6*c* are transparent and preferably made of glass. Also, non-transparent wall panels 6*c* are also possible, for example as a canvas, stretched in a frame. Their function is mainly wind and water protection, but depending on their material, sun protection is also possible. The same type of wall infill, i.e. foldable wall panels 6*c*, is also shown in FIG. 2G. However, in this case, the panels 6*c* are located below the external pivot beam 3, while, in the embodiment of FIGS. 2E and 2F, the panels 6*c*, in their closed state, almost completely cover the external pivot beam 3.

Figure 2H:
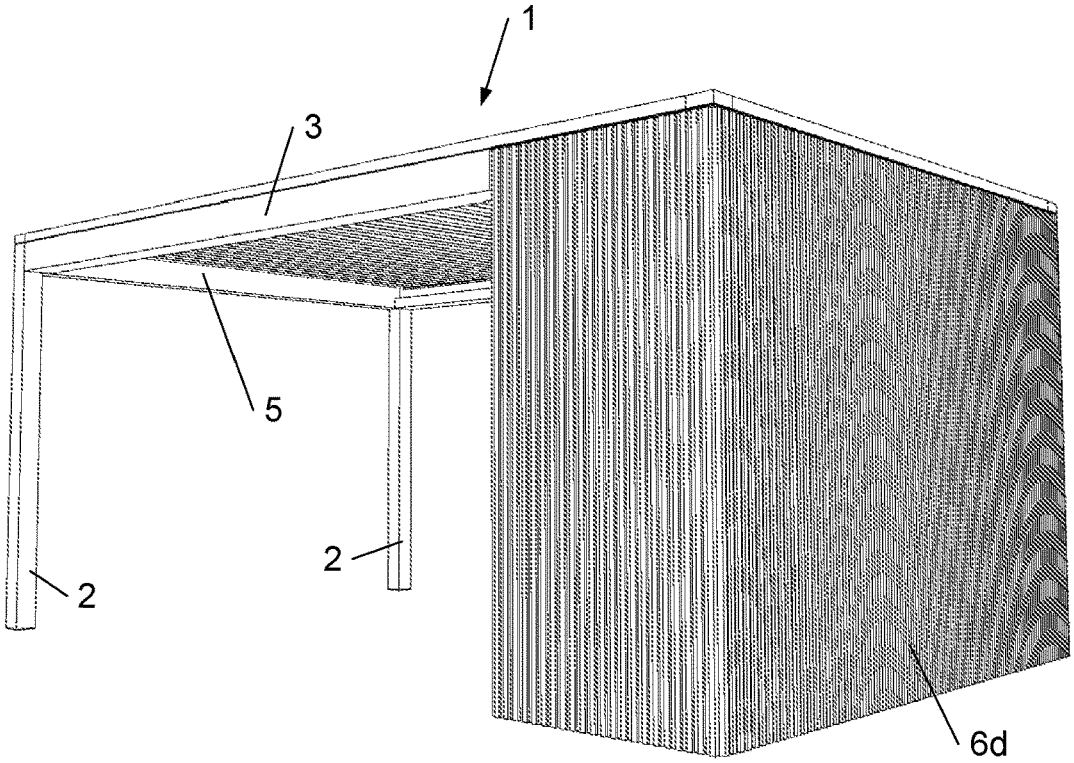
Figure 2I:
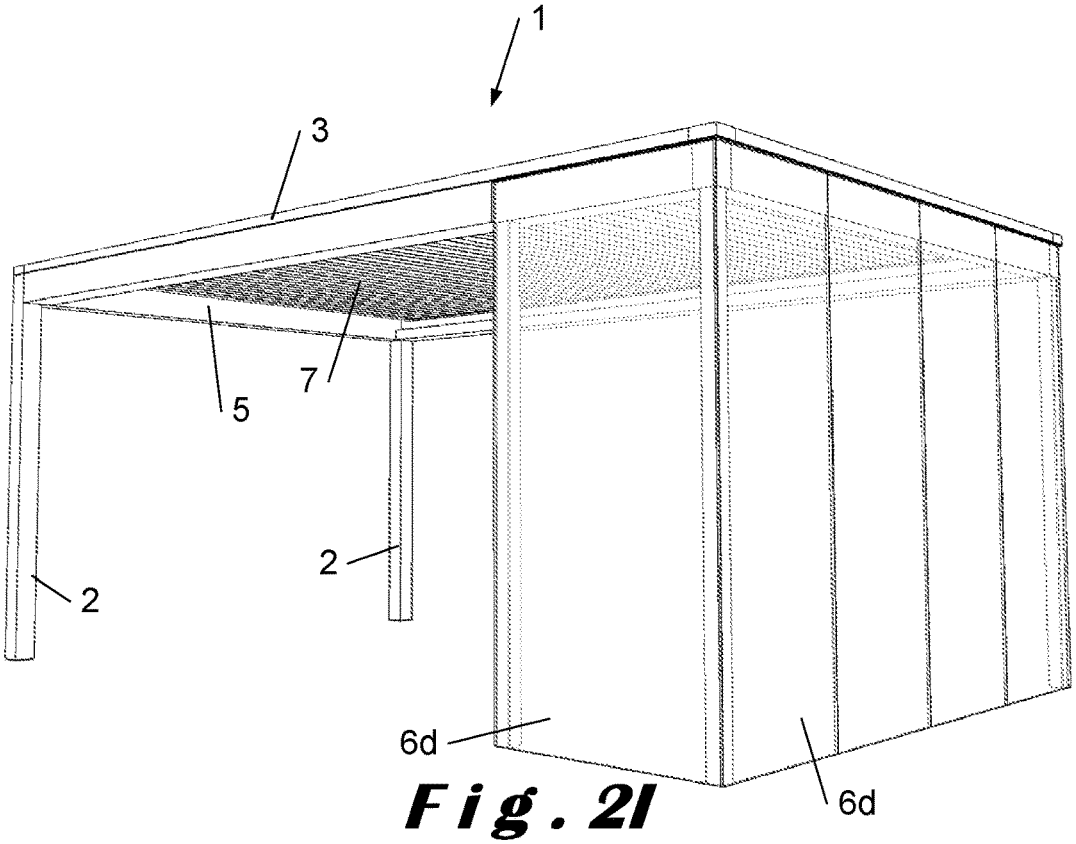
Figure 2J:
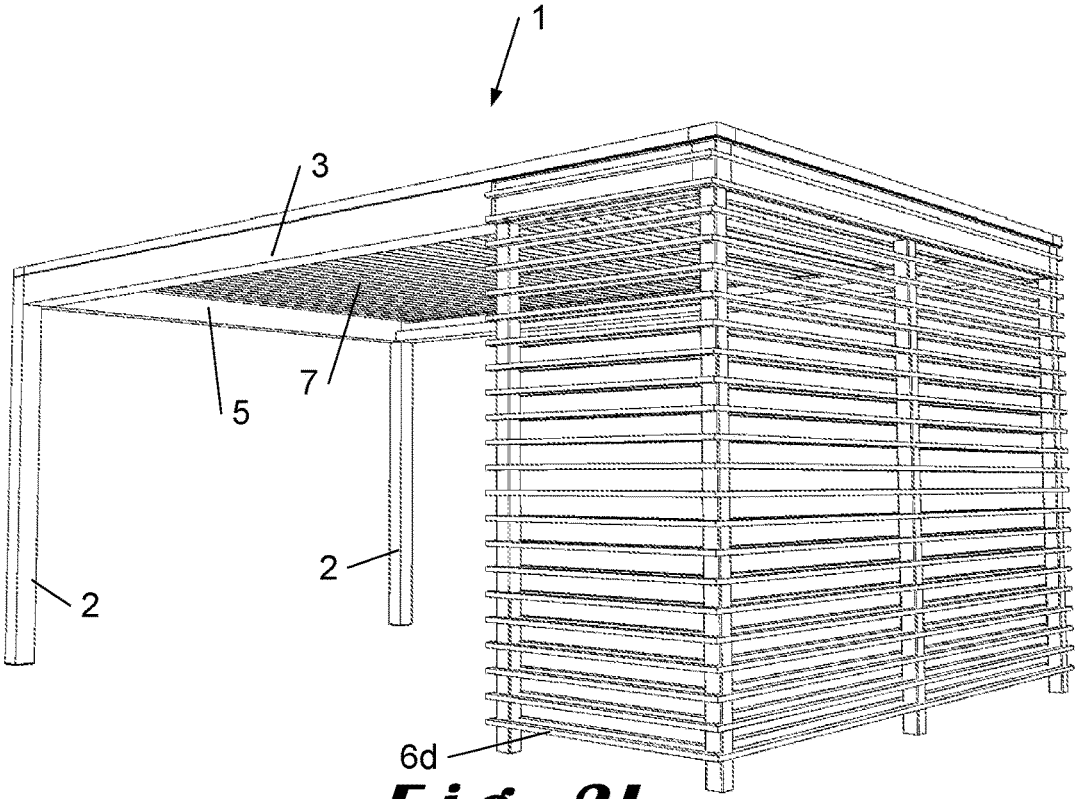

FIGS. 2H to 2J illustrate stationary wall infills 6*d*. The characteristic feature of the stationary wall infill 6*d* is that it is possible to have it continue uninterruptedly on the outer side of a column 2. In other words, the column 2 may be hidden from view as in FIG. 2H. The stationary wall infill 6*d* can also be completely transparent as in FIG. 2I or partly transparent as in FIG. 2J. The function of a stationary wall infill depends on the type and generally includes wind, water and sun protection.

The different variations of beams 3, 4, 5 will be described with reference to FIGS. 3 to 6. The beams 3, 4, 5 are constructed from one or more profiles, as described hereafter. The profiles are typically manufactured of a rigid material. This can be aluminium, for example. Aluminium has many advantages as a profile material, as it is at the same time robust and light-weighted, it can withstand bad weather conditions and requires little maintenance. However, other materials are also suitable and their advantages or disadvantages are assumed to be known by the skilled person. A profile can be produced using various techniques depending on the material, including extrusion, cutting, setting, casting, welding, etc., with extrusion being the preferred technique. The appropriate production technique is assumed to be known by the skilled person.

The beams 3, 4, 5 of the terrace canopy 1 are hollow as is apparent from FIGS. 3 to 6. The beams 3, 4, 5 are composed of a plurality of profiles 10, 11, . . . , 24. Hereinafter, the different profiles of the beams and their interconnection are briefly discussed. It goes without saying that several variants are conceivable for both the composition of the beams and the interconnection of the profiles, as well as that the specific design of the profiles may differ. In addition, it is also possible that the functionality of different profiles is combined into the same integrally manufactured profile, for instance it is possible to form the base profile 12 together with the intern or external gutter profile 11, 13 as an integrally formed core profile.

It is generally intended to indicate profiles with the same placement and functionality, but with a divergent design with the same reference numeral by using one or more accent marks, e.g. base profile 12 and 12" in FIGS. 3A and 4. It is generally intended to indicate profiles with the same placement but with a modified form as a result of a modification in functionality of the beam by the same reference numeral by the use of letters, for example finishing profile 14, 14*a* in FIGS. 3A and 3C.

To form the beams 3, 4, 5, the profiles 10, 11, . . . , 24 are interconnected in a specific way. Generally, use is made of pin connections and/or hook connections. In a pin connection typically an elastic element (not shown) is present in a female element, for example a slot element, into which a male element, for example a pin, engages. Hence, a pin connection generally includes an elastically interlocking male and female element; an additional elastic element may be provided for this purpose, but this is not necessarily the case. The elasticity may also arise from the design of the male and female elements. Hook connections typically involve two elements with such a design that they hook into each other. There is no elastic element and the connection is separated by moving the elements away from each other in the correct direction.

In addition, generally, for each interconnection of two profiles, use is made of two separate connections. This improves the strength of the connection, but mainly contributes to the correct mutual positioning of the profiles. The fact is that if only one connection is used for two profiles, there is more clearance in the mutual positioning, which can give rise to a divergent positioning, in particular due to wind loads and/or precipitation loads.

A first design of an external pivot beam 3 is shown in FIG. 3A. The pivot beam 3 is intended not to be provided with a wall infill 6. The pivot beam 3 comprises an interconnected base profile 12 and a double gutter profile 13. The base profile 12 and the double gutter profile 13 are also shown per se in FIGS. 6A and 6B.

The base profile 12 (see FIG. 6A) comprises an upright wall 100 of which a horizontal wall 101 extends to the outer side of the base profile. The upright wall 100 is provided at the bottom with a first lower connection means 103, in particular a hooking means. The upright wall 100 also has a bottom branch 104 which ends in a second lower connection means 105. The lower connection means 103, 105 serve to attach the base profile 12 with the double gutter profile 13.

The double gutter profile 13 (see FIG. 6B) has a central cavity 27 which is formed at the top side by an upper horizontal wall 200. The wall 200 ends on its inner side in an upright branch 202 which ends in a first upper connection means 203, in particular a hooking means. The horizontal wall 200 is provided on its top side with an upper branch 201 which serves as the second upper connection means 205. The base profile 12 and the double gutter profile 13 are interconnected by, on the one hand, hooking the hooking means 103, 203 into each other (i.e. hook connection 51) and, on the other hand, to connect the walls 105, 205 directly to each other, for example by riveting them (connection 53). Alternatively, these profiles may be manufactured integrally as one single core profile. The drawback here is that such a profile, in view of the considerable height, is not easy to manufacture by means of an extrusion process.

FIG. 5A further illustrates that the upright wall 100 of the base profile 12 is provided on its top side with a bend 106, through which a first upper connection means 102, in particular a female pin connection means, is provided further to the outer side of the base profile 12. As shown in FIG. 3A, the first upper connection means 102 is used to connect the cover profile 15. The cover profile 15 comprises a horizontal wall 400 which merges at its ends into two upright walls 401, 402 and is therefore substantially U-shaped, which is advantageous for avoiding or at least reducing infiltrating water. The bottom side of the horizontal wall 400 is provided with two connection means 403, 404, in particular pins. The pin 403 is used together with the first upper connection means 102 for connecting the cover profile 15 to the base profile 12. Due to the bend 106, the upright wall 100 of the base profile 12 and the upright wall 401 of the cover profile 15 are in the same plane.

The cover profile 15 serves to close off a technical space 26 in the external pivot beam 3. This technical space 26 may serve to house drive means for tilting the slats of the roof covering 7 and/or cabling for, for example, lighting, etc. In other words, the slats of a roof covering 7 are attached to a wall part 100*a* (see FIG. 6A) which forms part of the upright wall 100 and extends between the horizontal wall 101 and the bend 106. In particular, the slats are partially positioned through these and fixedly attached to an attachment mechanism (not shown) inside the technical space 26. The presence of this attachment mechanism is also part of the reason why the horizontal wall 101 comprises two wall parts 101*a*, 101*b* which are at different heights and are connected by a bend 107. The lower placement of wall part 101*a* leaves sufficient space for the attachment mechanism, while the higher placement of wall part 101*b* allows the necessary space for arranging a roll-in/roll-out screen in a screen cavity 25.

The horizontal wall is provided near its end with a plurality of connection means, the functionality of which is described hereafter. The connection means comprise a first connection means 108, in particular a hooking means formed by two hooks, and a second connection means 109, in particular a slot. These connection means serve for the attachment of a front cover 14 for shielding the screen cavity 25. This front cover 14 typically forms the outer side of the external pivot beam 3.

The front cover 14 is attached to the base profile by means of a connection profile 16. The connection profile 16 comprises a hollow chamber formed between four walls 411, 412, 413, 414. The wall 414 forms the top side of the connection profile 16 and is provided with a first connection means 35, in particular a hooking means formed by two hooks, corresponding to the first connection means 108. From the top wall 414, a branch 415, in particular elastically deformable, extends towards the inner side of the external pivot beam 3. The end of branch 415 engages in a notch 110 in the base profile 12. On the bottom wall 412, the connection profile 16 is provided with a second connection means 416, in particular a female pin connection means. The second connection means 416 serves for receiving a corresponding second connection means 36, in particular a pin. This second connection means 36 is provided on the inner side of the front cover 14. A further attachment of the front cover 14 to the base profile 12 is formed, in particular by a pivotal movement, by placing the end part 37 of the front cover 14 in a slot 109 in the base profile 12 intended for this purpose.

In itself, the above-described attachment of the front cover 14 to the base profile 12 is sufficient. However, in view of the relatively long distance over which the front cover 14 downwardly extends, it is preferable to use an additional support profile 17 and/or a filler profile 18. The support profile 17 comprises a horizontal wall 420 terminating in a first connection means 421, in particular a female pin connection means. A corresponding connection means 39, in particular a pin, is provided on the inner side of the front cover 14. At the other end of the horizontal wall 420, an upright wall 422 and a branch 423, in particular elastically deformable, are provided. The upright wall 422 serves as an abutment against the internal cavity 27 of the double gutter profile 13, i.e. against the outer upright wall 206. The end of the upright wall 422 engages in a notch 207 in the double gutter profile 13, in particular a notch 207 in the outer side wall 206 of the cavity 27. Similarly, the end of the branch 423 engages in an opening 208 near the corner of the internal cavity 27.

The filler profile 18 is generally U-shaped with a flat bottom side 430 and upright side walls 431, 432. The upright side wall 432, in particular the end thereof, is intended to be fixedly connected to wall part 209*a* of an outer upright branch 209 of the double gutter profile 13. In an example, rivets are used for this connection. The remaining upright side wall 431 is free and serves as an abutment for the bottom side of the front cover 14. If desired, the upright side wall 431 can also be fixedly attached to the front cover 14. Finally, it should be noted that the upright side wall 432 is provided with a connection means 433, in particular a pin, the function of which will be described later.

In the embodiments shown, the front cover 14 is further provided with a reinforcing rib 41 and a slot 42. The reinforcing rib 41 contributes to the rigidity of the front cover 14 and is useful for obtaining the required resistance at higher loads, especially when bridging relatively long lengths. The function of the slot 42 is hereafter described with reference to FIG. 3B.

It is clear that the front cover 14 is detachable by disconnecting several of the connections. Thereby, the screen cavity 25 is accessible such that modifications, adjustments and/or repairs may be made, if necessary. In a similar manner, the cover profile 15 is removable for modifications, adjustments and/or repairs of elements in the technical space 26, such as the drive of the slats that may form the roof infill 7.

Figure 6A:
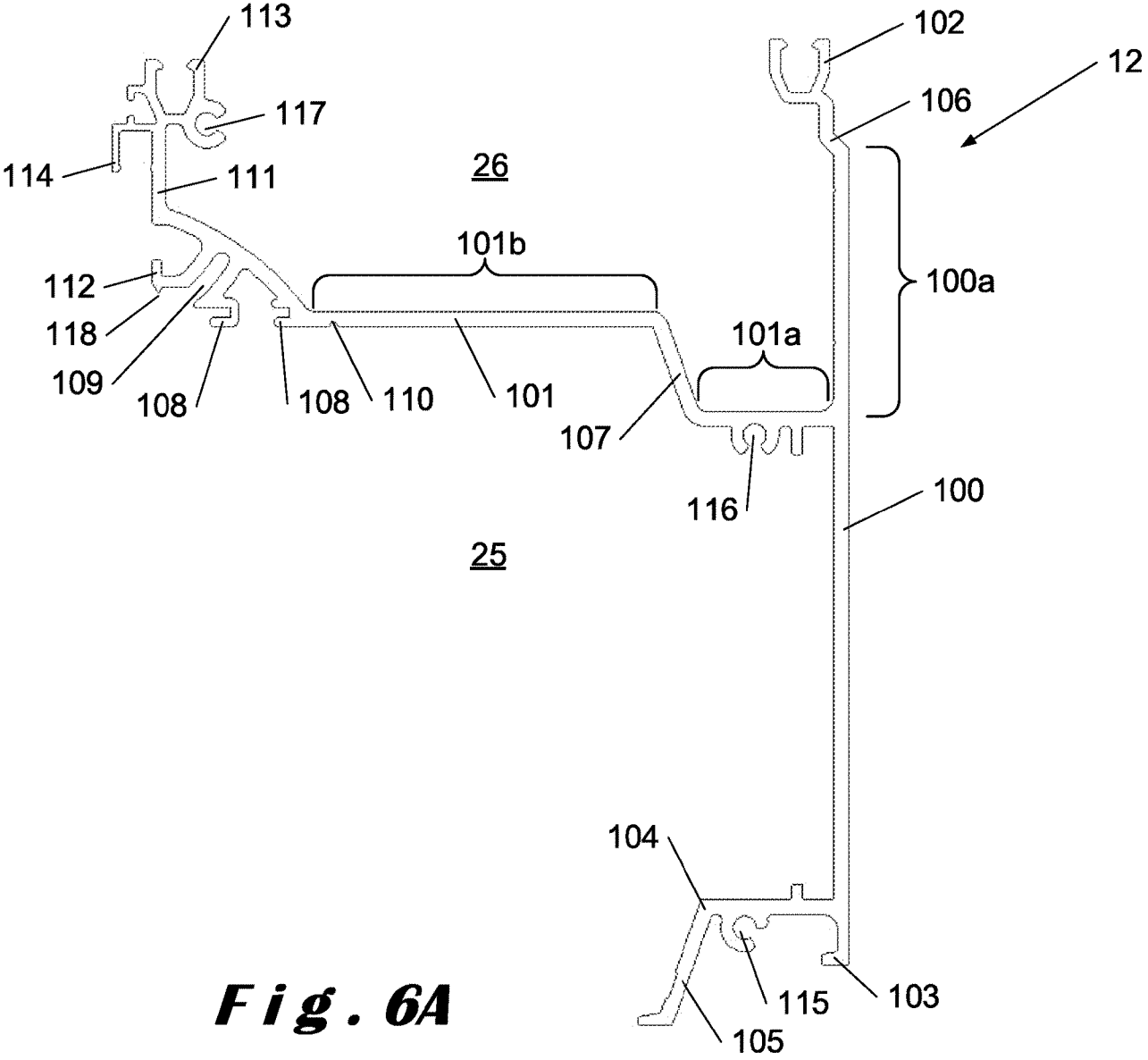
FIGS. 6A to 6C show individual profiles used in the construction of the external pivot beam and/or the tension beam.

FIG. 6A further illustrates that the horizontal wall 101 merges into an outer upright wall 111 which is provided on its bottom side with a lower connection means 112, in particular a hooking means, and on its top side is provided with a second upper connection means 113, especially a female pin connection means. As shown in FIG. 3A, the second upper connection means 113 is used to connect the cover profile 15 via pin 404. Also, the outer side of the upright wall 111 is provided with a branch 114 that may serve as connection means and/or container for one or more components that need to be introduced into space 32. An opening 33 is provided between the front cover 14 and the cover profile 15, in particular the outer side wall 402 thereof.

Figure 6B:
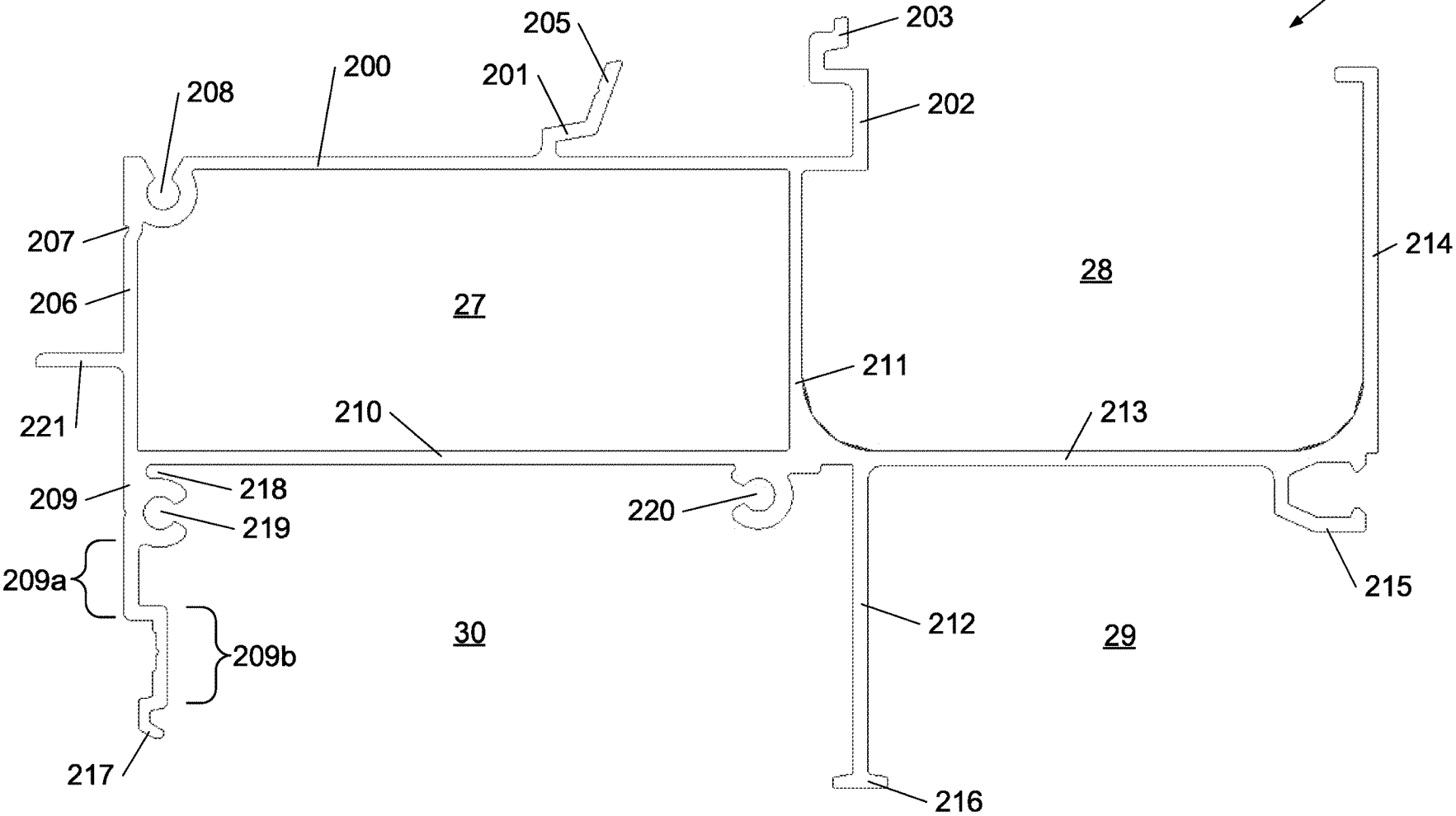

FIG. 6B shows more details about the double gutter profile 13 of the external pivot beam 3, shown in FIG. 3A. The double gutter profile 13 comprises an upper horizontal wall 200, an outer upright wall 206, a lower horizontal wall 210 and an upright intermediate wall 211 which together enclose the cavity 27. Further walls of the double gutter profile 13 are a lower outer branch 209 which is substantially the extension of the outer side wall 206, a horizontal branch 213 which is substantially an extension of the lower horizontal wall 210, a lower inner branch 212 which is substantially the extension of the intermediate wall 211, and an upright inner side wall 214 extending upwardly from the end of the branch 212 and defining a space 28 together with the branch 212 and the intermediate 211. The walls 209, 212, 213 of the double gutter profile 13 also form a number of spaces. For example, there is a space 29 located below the external gutter 28 and next to the branch 212. Furthermore, there is also a space 30 located between the branches 209, 212. The purpose of these spaces 29, 30 is described hereafter with reference to FIGS. 3D to 3G. However, in the external pivot beam 3 of FIG. 3A, these spaces have no function, such that they can be hidden from view by providing a closure profile 19.

The external pivot beam 3 is intended to be placed on the outer side of the terrace canopy 1 and should provide for water drainage of precipitation incident on the terrace canopy. In particular, this precipitation may, for example, be collected by a slatted roof 7 which drains precipitation to this pivot beam 3. The roof infill 7 drains the precipitation to the pivot beam 3 where it is collected in the external gutter 28. Between the external gutter 28 and the cavity 27 the intermediate wall 29 is present which is provided with one or more openings, for example a series of perforations, such that the precipitation from the external gutter 28 is diverted to the cavity 27. That is why the bottom of the external gutter 28 also preferably slopes towards the cavity 27. The cavity 27 serves as an internal gutter for the passage of precipitation from one or more adjoining pivot beams 3 to a column 2 along which this precipitation may leave the terrace canopy 1.

Furthermore, the double gutter profile 13 is further provided with an inner connection means 215, in particular a female pin connection means, of a lower inner connection means 216, in particular a hooking means, which forms the end of the branch 212 of a lower outermost connection means 217, in particular a hooking means, which forms the end of the branch 209, and a connection means 218, in particular a hooking means, just below the inner gutter 27. The function of the lower outer connection means 217 will be described with reference to FIG. 3G, while the function of the connection means 215, 216 and 218 is described hereafter.

The closure profile 19 is substantially U-shaped with a lower wall 440 and two upright walls 441, 443. The lower wall 440 is provided on its top side with a connection means 445, in particular a hooking means, provided to cooperate with the lower inner connection means 216 for the attachment of the closure profile 19 to the double gutter profile 13. The upright inner wall 443 is provided on its top side with a connection means 444, in particular a pin, provided to cooperate with the inner connection means 215 for attaching the closure profile 19 to the double gutter profile 13. Furthermore, the upright outer wall 441 is provided on its top side with a connection means 442, in particular a hooking means, provided to cooperate with the connection means 218 for attaching the closure profile 19 to the double gutter profile 13. The lower outer connection means 446 is in turn provided to cooperate with the connection means 433 on the filler profile 18 for their interconnection.

Furthermore, the external pivot beam 3 is further provided with screw channels 115, 116, 117, 208, 219, 220 for screwing a headboard to an end of this beam 3 with the aid of screws or bolts for the purpose of connecting the beam with a column of the terrace canopy 1. Screw channel 115 is provided on the bottom side of the branch 104; screw channel 116 is provided on the bottom side of wall part 101*a*; screw channel 117 is provided adjacent to the second upper connection means 113 in the technical space 26; the screw channel 208 is provided on the upper outer corner of the internal gutter 27; and the screw channels 219, 220 are provided below the internal gutter 27 on either side thereof. Of course, more or less screw channels are also possible and/or the placement thereof may differ.

It should be understood that other ways are possible with fewer or more connection means to interconnect the different profiles forming the external pivot beam 3. Additional connections, for example by means of glue, bolts, rivets, etc., may also be provided between certain profiles in order to interconnect these substantially permanently. Rivets can be used, for example, to connect walls 105, 205 or walls 209*b*, 441 or walls 209*a*, 432.

As already described above, the external pivot beam 3 (FIG. 3A) is intended to not use a wall infill, unlike the external pivot beams of FIG. 3B and onwards. This also immediately means that this external pivot beam 3 is almost completely visible in the terrace canopy 1. It is therefore advantageous that the visible surfaces have a sleek finish. Examples include: the co-planarity of the front cover 14 and the cover wall 402; the co-planarity of the upright wall 100 of the base profile 12 and the cover wall 401; the co-planarity of the filler profile 18 and the closure profile 19; the only sporadic presence of an opening between visible profile surfaces; etc.

FIG. 3B illustrates a second type of external pivot beam, wherein the pivot beam is intended to form a side wall 6. Identical elements will be indicated by the same numeral and are not described.

The pivot beam of FIG. 3B is designed to hold a roll-in/roll-out screen 6*a* serving as a side wall (see FIG. 2A) and arranged in the screen cavity 25. The main difference with the pivot beam of FIG. 3A is the absence of support profile 17 and filler profile 18. Namely, these would disrupt the normal operation of the screen 6*a*. The slot 42 is provided for arranging therein a holder (not shown) which serves as an abutment for the screen 6*a* when it is rolled in. Alternatively, the slot 42 itself may serve as such a screen roller abutment. The wall 43 (which extends inwardly on the inner side of the front cover 14) and the wall 221 (which extends outwardly on the outer side of the inner gutter 27) may also serve as an abutment for the screen 6*a*.

FIG. 3C illustrates a third type of external pivot beam, wherein the pivot beam is intended to form a sidewall 6. Identical elements will be identified by the same numeral and are not described.

The pivot beam of FIG. 3C is designed to cooperate with a stationary wall (see FIGS. 2H to 2J). The main differences with the pivot beam of FIG. 3A are the design of the front cover 14*a* and the filler element 18*a* and the presence of a drip profile 24 as alternative on the connection profile 16.

The drip profile 24 has a substantially horizontal wall 450 which is provided on its top side with first connection means 35, in particular a hooking means formed by two hooks, corresponding to the first connection means 108 in the base profile 12. The drip profile 24 also has a second connection means 453, in particular a hook as the end of an elastically upright wall 454. This second connection means 453 engages a corresponding connection means 118 (see FIG. 6A), in particular a hook on the bottom side of the lower connection means 112, on the base profile 12. The connection means 35, 108, 118, 453 together ensure the attachment of the drip profile 24 to the base profile 12.

On its outwardly facing side, the drip profile 24 is finished with an upright wall 452 extending downwardly from the horizontal wall 450. In particular, this upright wall 452 is located substantially in the same plane as the cover wall 402. A slot 451 is provided at the bottom side of the horizontal wall 450 which has the same function as slot 109 in the base profile 12, namely an attachment for the front cover 14*a*, in particular the end 37*a* thereof. There is also the opening 33 present between the outer side wall 402 of the cover profile 15 and the upright wall 452 of the drip profile 24.

The front cover 14*a* has again a substantially flat outer side, which, in this embodiment, does not lie in the same plane as the cover wall 402, but is located more towards the inner side of the external pivot beam 3. In particular, the distance between the outer side of the front cover 14*a* and the upright wall 100 of the base profile 12 is smaller than before. This allows to place the stationary wall 6*d* such that it lies substantially in the same plane as the cover wall 402. In particular, the stationary wall 6*d* is located between the outer side of the front cover 14*a* and the upright wall 452 of the drip profile 24 with its top side substantially against the bottom side of the horizontal wall 450. This also immediately explains the additional function of the drip profile 24, in particular the wall 452, namely, to prevent the incidence of precipitation on the top side of the stationary wall 6*d*, which precipitation may could damage, discoloration, etc. at the stationary wall 6*d*.

Again, the front cover 14*a* is provided on its inner side with a reinforcement 41*a* which, although the modified shape compared to the front cover 14, has the same function. A filler profile 18*a* is also provided on the bottom side of the external pivot beam 3. Although the design of the filler profile 18*a* is changed, compared to the filler profile 18 shown in FIG. 3A, the function is unchanged, namely closing off the space between the front cover 14*a* and the double gutter profile 13. Further details are therefore not included.

It should be understood that, in an embodiment wherein the stationary wall 6*d* is not transparent, it is not necessary to mount the front cover 14*a* on the external pivot beam 3. After all, the front cover 14*a* is not visible in such an embodiment. However, the filler profile 18*a* must be made slightly wider such that it fits closely with the stationary wall 6*d* such that, seen from the inside of the terrace canopy 1, the pivot beam 3 is finished almost without a visible opening between the pivot beam 3 and the stationary wall 6*d*.

FIG. 3D illustrates a fourth type of external pivot beam, wherein the pivot beam is intended to form a side wall 6. Identical elements will be identified by the same numeral and are not described. Changes have also been made to the design of the base profile 12', the double gutter profile 13', the front cover 14', the cover profile 15', the connection profile 16' and the support profile 17' without any change to the functionality such that the modified design is not explained in more detail. It should be noted, however, that connection means 108 which is formed by two hooks (see FIG. 6A) in base profile 12 is now formed by one hook 108'*a* and one abutment 108'*b*.

The pivot beam of FIG. 3D is designed to cooperate with a movable wall 6*b*, 6*c* (see FIGS. 2B, 2C and 2G). The main difference with the pivot beam of FIG. 3A is the presence of a wall profile 21 in space 29 below the external gutter 28. This also changes the design of the closure profile 19*a*.

In this embodiment, the closure profile 19*a* only serves to close off space 30 below the internal gutter 27. The closure profile 19*a* comprises a horizontal wall 440*a* which merges on its outwardly facing side into an upright wall 441*a* which, unlike upright wall 441, is located between the filler profile 18 and the lower outer branch 209 of the gutter profile 13'. In particular, the upper end of the upright wall 441*a* is connected to wall part 209*b* (see FIG. 6B), for example by means of rivets or the like. Connection means 446 is identical to the pivot beam of FIG. 3A and is not further described. At the inwardly facing end of the horizontal wall 440*a*, a connection means 445*a*, in particular a hooking means, is provided to cooperate with the lower inner connection means 216 for attaching the closure profile 19*a* to the double gutter profile 13'.

As already described, the external pivot beam of FIG. 3D serves for cooperation with a movable wall 6*b*, 6*c*. The wall profile 21 is provided with a guide chamber 460 formed by two upright walls 461, 462 connected to a horizontal upper wall 463. The upright walls 461, 462 together form a rail 464 into which one or more rollers (not shown) can be movably mounted. The wall profile 21 is further provided with a lower wall 465 with an opening 469 therein which opens onto guide chamber 460. A portion of the rollers and/or the wall extends through the opening 469. At the outwardly facing end of the lower horizontal wall 465, a connection means 468 is provided, in particular a hooking means, which is provided to cooperate with the lower inner connection means 216 for attaching the wall profile 21 to the double gutter profile 13'. On the inwardly facing side of the lower wall 465, it merges into an upright wall 466 which is provided at the top with a connection means 467 (corresponding to connection means 444 of closure profile 19), in particular a pin, provided to cooperate with the inner connection means 215 for attaching the wall profile 21 to the double gutter profile 13'. To increase the dimensional stability of the wall profile 21, the top wall 463 of the guide chamber 460 extends against the inner side wall 466.

Considering the presence of only one rail 464 in the external pivot beam of FIG. 3D, this means that only two types of movable wall 6*b*, 6*c* are possible. In particular, it is possible to provide a side wall with only one movable panel 6*b*, slidable in the longitudinal direction of the external pivot beam 3. In other words, this forms a side wall 6*b* as in FIGS. 2B and 2C with only one or two panels instead of the six panels shown there (three on either side of the terrace canopy 1). Alternatively, a foldable side wall 6*c* is possible, as shown in FIG. 2G.

FIG. 3E illustrates a fifth type of external pivot beam, wherein the pivot beam is intended to form a side wall 6. Identical elements will be identified by the same numeral and will not be described.

The pivot beam of FIG. 3E is designed to cooperate with a movable wall 6*b*, 6*c* (see FIGS. 2B and 2C). The main difference with the pivot beam of FIG. 3A is the presence of a wall profile 21 in space 30 below the internal gutter 27. This has also changed the design of the closure profile 19*b*.

The closure profile 19*b* now only serves to close off space 29 below the external gutter 28. The closure profile 19*b* comprises a horizontal wall 440*b* which merges on its inwardly facing side into an upright wall 443, which is provided with a pin 444, identical as with the pivot beam of FIG. 3A, such that a further description is unnecessary. The horizontal wall 440*b* is provided at its outwardly facing end with a connection means 445*b*, in particular a hooking means, provided to cooperate with the lower inner connection means 216 for attaching the closure profile 19*b* to the double gutter profile 13.

As already described, the external pivot beam of FIG. 3E serves for cooperation with a movable wall 6*b*. The wall profile 21*a* is provided with two guide chambers 460 which are formed in the same way as the guide chamber 460 of wall profile 21 described with reference to FIG. 3D. Hence, there are the inner and outer upright walls 461, 462 which form the rails 464 and are connected to the horizontal wall 463. For reinforcement, a horizontal wall portion 463*a* is also provided, connecting the horizontal walls 463 of the separate guide chambers 460. The lower wall 465*a* is correspondingly provided with two openings 469, one for each guide chamber 460.

A connection means 468*a* is provided at the inwardly facing end of the lower horizontal wall 465*a*, in particular a hooking means, which is provided to cooperate with the lower inner connection means 216 for attaching the wall profile 21*a* to the double gutter profile 13. At the outwardly facing end of the lower wall 21*a*, an upright wall 470 is provided, which is located between the filler profile 18 and the lower outer branch 209 of the gutter profile 13. In particular, the upper end of the upright wall 470 is connected to wall part 209*b* (see FIG. 6B), for example by means of rivets or the like. Also provided is a connection means 471 which is similar to connection means 446 as with the pivot beam of FIG. 3A and serves to cooperate with connection means 433 on filler profile 18 for their interconnection.

In view of the presence of two rails 464 in wall profile 21*a*, it is possible to provide in each rail one or two movable panels 6*b* which are slidable in the longitudinal direction of the pivot beam 3, for example by using rollers (not shown). The panels 6*b* in the different rail can pass along each other. In other words, this forms a side wall 6*b* as in FIGS. 2B and 2C with only two or four panels instead of the six panels shown there (three on either side of the terrace canopy 1). If desired, a combination can also be made of sliding panels 6*b* in one of the rails 464 and folding panels 6*c* in the other rail.

FIG. 3F illustrates a sixth type of external pivot beam, wherein the pivot beam is intended to form a sidewall 6. Identical elements will be identified by the same numeral and are not described.

The pivot beam of FIG. 3F is designed to cooperate with a movable wall 6*b*, 6*c* (see FIGS. 2B and 2C). The main difference with the pivot beam of FIG. 3E is the presence of a third rail 464 where normally the filler profile 18 is present. The wall profile 21*b* is provided with three guide chambers 460 which are formed in the same way as the guide chamber 460 of wall profile 21, 21*a*, described with reference to FIGS. 3D and 3E. The lower wall 465*b* is therefore correspondingly provided with three openings 469. The connection of the wall profile 21*b* on its inner side with the double gutter profile 13 is identical as for wall profile 21*a* and will not be described in more detail. On its outwardly facing side, the connection of the wall profile 21*b* with the double gutter profile 13 is formed by an upright wall 472 which extends upwardly from the horizontal wall 463 of the most outwardly extending guide chamber 460. This upright wall 472 ends in an upper connection means 473, in particular a hooking means, which cooperates with the wall 221 (which extends outwardly on the outer side of the inner gutter 27). The lower end of the front cover 14 abuts against the outer end of the horizontal wall 465*b* of the wall profile 21*b*.

In view of the presence of three rails 464 in wall profile 21*b*, it is possible to provide in each rail one or two movable panels 6*b* which are slidable in the longitudinal direction of the pivot beam 3, for example by using rollers (not shown). The panels 6*b* in the different rail can pass along each other. In other words, this forms a side wall 6*b* as in FIGS. 2B and 2C. If desired, a combination can also be made of sliding panels 6*b* in two of the rails 464 and folding panels 6*c* in the other rail.

FIG. 3G illustrates a seventh type of external pivot beam, wherein the pivot beam is intended to form a sidewall 6. Identical elements will be identified by the same numeral and are not described.

The pivot beam of FIG. 3G is designed to cooperate with a movable wall 6*b* (see FIG. 2D). The main difference with the pivot beam of FIG. 3E is the design of the wall profile 21*c* with respect to the wall profile 21*a*. The wall profile 21*c* comprises a horizontal upper wall 463*c* from which five upright walls 461*c* extend downwardly to form four guide chambers 460*c*. At the bottom, the most inwardly facing upright wall 461*c* is provided with a horizontal branch 465*c* comprising a connection means 468*c*, in particular a hooking means, which is provided to cooperate with the lower inner connection means 216 for the attachment of the wall profile 21*c* to the double gutter profile 13. The attachment to the outer upright wall 461*c* is formed by fixedly connecting this wall to wall part 209*b* (see FIG. 6B), for instance by means of rivets or the like. Furthermore, a connection means 471*c* is also provided which is similar to connection means 446 as with the pivot beam of FIG. 3A and serves to cooperate with connection means 433 on filler profile 18 for their interconnection.

The wall profile 21*c* is typically intended for slidable wall panels 6*b* that are thinner, in comparison to the wall profiles 21, 21*a* and 21*b*. In particular, the wall profile 21*c* is intended for glass wall panels in which a maximum of four (or eight) panels 6*b* can slide along each other, as shown in FIG. 2D. Due to the lower weight of the wall panels 6*b* (in view of their relatively low thickness) it is possible to use less strong rails 464*c*, whereby wall profile 21*c* is compact such that more wall panels 6*c* can be provided in the transverse direction of the pivot beam 3. This compact wall profile 21*c* also allows other forms of wall infill, for instance a screen 6*a*, to be present in order to arrive at the terrace canopy shown in FIG. 2D. In addition, with glass wall panels 6*b*, rollers are typically provided on the bottom side of the panels on the ground guide 99 such that the guide in the rails 460*c* can be embodied more compact or even omitted altogether.

FIG. 3H illustrates an eighth type of external pivot beam, wherein the pivot beam is intended to form a sidewall 6. Identical elements will be identified by the same numeral and are not described.

The pivot beam of FIG. 3H is designed to cooperate with a movable wall 6*b*, 6*c* (see FIGS. 2E and 2F). The main difference with the pivot beam of FIG. 3A is the presence of a wall profile 20 that is positioned outwardly relative to the front cover 14*a*', which therefore also has a modified design, in particular the same design as the front cover 14*a* with a stationary wall infill, described with reference to FIG. 3C, such that a further description is not included here. It should be noted, however, that the front cover 14*a*' is located at a different distance from the upright wall 100 of the base profile 12 compared to the front cover 14*a* of the pivot beam 3, shown in FIG. 3C. The design of the cover profile 15*a* is also changed. In particular, the horizontal wall 400*a* has a longer length such that the distance between the pins 403, 404 is larger and such that the outer upright wall 402 is at a larger distance from the upright wall 100 of the base profile 12. This longer length allows to integrate the wall profile 20 into the design of the pivot beam 3 without adversely affecting the quality of the finish.

The wall profile 20 includes a guide chamber 480 which is identical to that of wall profiles 21, 21*a* and 21*b*. The guide chamber 480 is therefore limited by inner and outer upright walls 481, 482, an upper horizontal wall 483 connecting the upright walls 481, 482, and a lower wall 485 having an opening 496 therein.

The upright walls 481, 482 together form a rail 484 into which one or more rollers (not shown) can be movably arranged. A portion of the rollers and/or the wall extends through the opening 496.

The lower wall 485 has, on its inwardly-facing end, a slot 490 for receiving the end 37*a* of the front cover 14*a*' for the attachment of the front cover 14*a*' to the wall profile 20. This slot 490 is, in particular, formed by a downwardly extending branch 499 that departs from the bottom side of the lower wall 485. At the inner end of the lower wall 485, it merges into an upright wall 486 which has a bend 497 near the centre such that a lower portion of wall 486 is located more inwardly relative to an upper portion thereof. The upright wall 486, in particular the lower part thereof, is provided on its inner side with a first inner connection means 487, in particular a hooking means. The first inner connection means 487 serves to cooperate with the lower connection means 112 (see FIG. 6A) for connecting the wall profile 20 to the base profile 12. The bend 497 allows the upper part of the wall 486 to be positioned more outwardly and to abut against the branch 114. At the top of the upright wall 486 it merges into an upper horizontal wall 488. Also, the upper wall 483 of the guide chamber 480 is connected to this upper wall 488 by support member 495. The horizontal wall 488 is on its inner end provided with a second inner connection means 489, in particular a hooking means, which hooks over the second upper connection means 113 for connecting the wall profile 20 to the base profile 12.

The outer wall 481 of the guide chamber 480 also has an upward upright branch 492 which is provided on its top side with an upper connection means 491, in particular, a female pin connection means. As shown in FIG. 3H, the upper connection means 491 is used to connect the cover profile 15*a* via pin 404. A connection wall 494 is provided between the horizontal wall 488 and the upright branch 492 for the strength and bearing capacity of the wall profile 20. A branch 493 is also provided on the outer side of the upright branch 492. The lower wall 485 is provided on its outwardly facing side with an upright finishing wall 498 which is located in the same plane as the outer side wall 402 of the cover profile 15*a*. An opening 33*a* is provided between walls 402, 498.

Considering the presence of only one rail 484 in the external pivot beam of FIG. 3H, this means that only two types of movable wall 6*b*, 6*c* are possible. The purpose of this rail 484 is to hold a foldable side wall, as shown in FIGS. 2E and 2F. However, as already described with reference to FIG. 3D, a single rail 484 can also be used to hold one or two sliding side wall panels. It should further be understood that, if desired, the wall profile 20 can also be provided with several mutually parallel chambers for guiding several wall panels.

FIG. 3I illustrates a ninth type of external pivot beam, wherein the pivot beam is intended to form a side wall 6. Identical elements will be identified by the same numeral and are not described.

The pivot beam shown in FIG. 3I has a combined functionality, namely that of the pivot beams shown in FIGS. 3C and 3H. In other words, the external pivot beam 3 has as side wall infill 6 both a portion with a fixed wall 6*d* and a portion with a movable, in particular a foldable, side wall 6*c*. For example, a fixed wall 6*d* is provided on one side of a side of the terrace canopy 1, while a foldable side wall 6*c* is present on the other side of the same side.

The front cover 14*a* and the drip profile 24 of the pivot beam of FIG. 3I are identical to those described with reference to FIG. 3C and the cover section 15*a* is identical to that described for the pivot beam of FIG. 3H. A further description is therefore not included here. In addition, the wall profile 20*a* is substantially identical to what was described with reference to FIG. 3H. The only difference is the absence of branch 499 which served as attachment for the front cover 14*a*. Now, this branch 499 is not necessary since the front cover 14*a* is held by the drip profile 24 and is closer to the upright wall 100 of the base profile 12 such that there is sufficient space for placing a fixed wall 6*d*.

FIG. 3J illustrates a tenth type of external pivot beam, wherein the pivot beam is intended to form a side wall 6. Identical elements will be identified by the same numeral and are not described.

The pivot beam shown in FIG. 3J has a combined functionality, namely that of the pivot beams shown in FIGS. 3C and 3E. In other words, the external pivot beam 3 has as side wall infill 6 both a portion with a fixed wall 6*d* and a portion with a movable, in particular a slidable, side wall 6*b*. For example, one side of a side of the terrace canopy 1 is provided with a fixed wall 6*d*, while on the other side of the same side there is a slidable side wall 6*b*, in particular formed by two wall panels.

All relevant profiles for the construction of the pivot beam shown in FIG. 3J have already been described with reference to FIG. 3C and/or 3E. A further description is therefore not included here.

FIG. 3K illustrates an eleventh type of external pivot beam, wherein the pivot beam serves for holding a lighting. Identical elements will be identified by the same numeral and are not described.

The pivot beam of FIG. 3K is substantially the same as the one shown in FIG. 3D with the difference that the wall profile 21 has been replaced by a lighting holder profile 10. The lighting holder profile 10 comprises two spaces 500, 501 in which lighting (not shown), such as one or more lamps, LED lighting, etc. can be installed. The space 500 can be used to illuminate the space below the terrace canopy 1, while the space 501 allows to illuminate the area below the pivot beam 3. The space 500 is substantially U-shaped and comprises an upright central wall 502, a top wall 503 and a bottom wall 504. The top wall 503 is provided at its end with an upright inner branch 505 having a connection means 506 thereon (corresponding to connection means 444 of closure profile 19), in particular a pin, provided to cooperate with the inner connection means 215 for attaching the lighting holder profile 10 to the double gutter profile 13'. The space 501 is substantially U-shaped and comprises an upright central wall 502, an top wall 507 and an outer side wall 508. The outer side wall 508 is provided at its bottom end with a connection means 509, in particular a hooking means, which is provided to cooperate with the lower inner connection means 216 for attaching the lighting holder profile 10 to the double gutter profile 13'. In the spaces 500, 501, additional mounting walls 510, 511 are also provided on which, among other things, the lighting can be attached. It is also possible to arrange diffusers and/or other elements in the spaces 500, 501 for optimizing the light quality. Furthermore, it should be understood that also only one of the spaces 500, 501 can be present.

It should also be understood that combinations of profiles that have not yet been shown, are possible to obtain yet other beams. For example, a beam according to one of the FIGS. 3E to 3F with an additional wall profile 20 according to FIG. 3H. This then allows to have several different types of panel wall infills on the same wall of the terrace canopy 1, for example a sliding wall below the beam and a folding wall on the outer side of the beam.

FIG. 4 illustrates a design of a tension beam 5. The tension beam 5 shown is intended not to be provided with a wall infill 6. The tension beam 5 shown comprises a base profile 12" and a single gutter profile 11 which are interconnected. The single gutter profile 11 is also shown per se in FIG. 6C. It is to be understood that, in embodiments not shown, the tension beam can be suited and intended for receiving and/or holding a wall infill by using the profiles shown in FIGS. 3B, 3C, 3E, 3F, 3G, 3H, 3I and/or 3J.

The tension beam 5 shown is generally the same as the pivot beam shown in FIG. 3A but with a different type of gutter profile, namely a single gutter profile 11 instead of a double gutter profile 13. Although the profiles 12", 14", 16", 18" of the tension beam 5 have a slightly different design, it should be understood that they are interchangeable with the profiles 12, 14, 16, 18, 12', 14', 16', 18' described above. It is also possible to replace one or more of the profiles 12, 14, 16, 18, 12', 14', 16', 18' in the external pivot beams 3 described above with its modified form of the same profile shown in the tension beam 5 of FIG. 4. Some of the modifications are briefly described. Notch 110 is not provided in the base profile 12", but this functionality is taken over by hook 108" which protrudes downwardly with respect to the horizontal wall 101". The branch 415" on connection profile 16" has been modified accordingly. The inner upright wall 432" of filler profile 18" is shorter and is directly connected to the upright outer side wall 441*a* of the closure profile 19*a* instead of on the gutter profile. The design of the slot 42" has been changed.

Figure 6C:
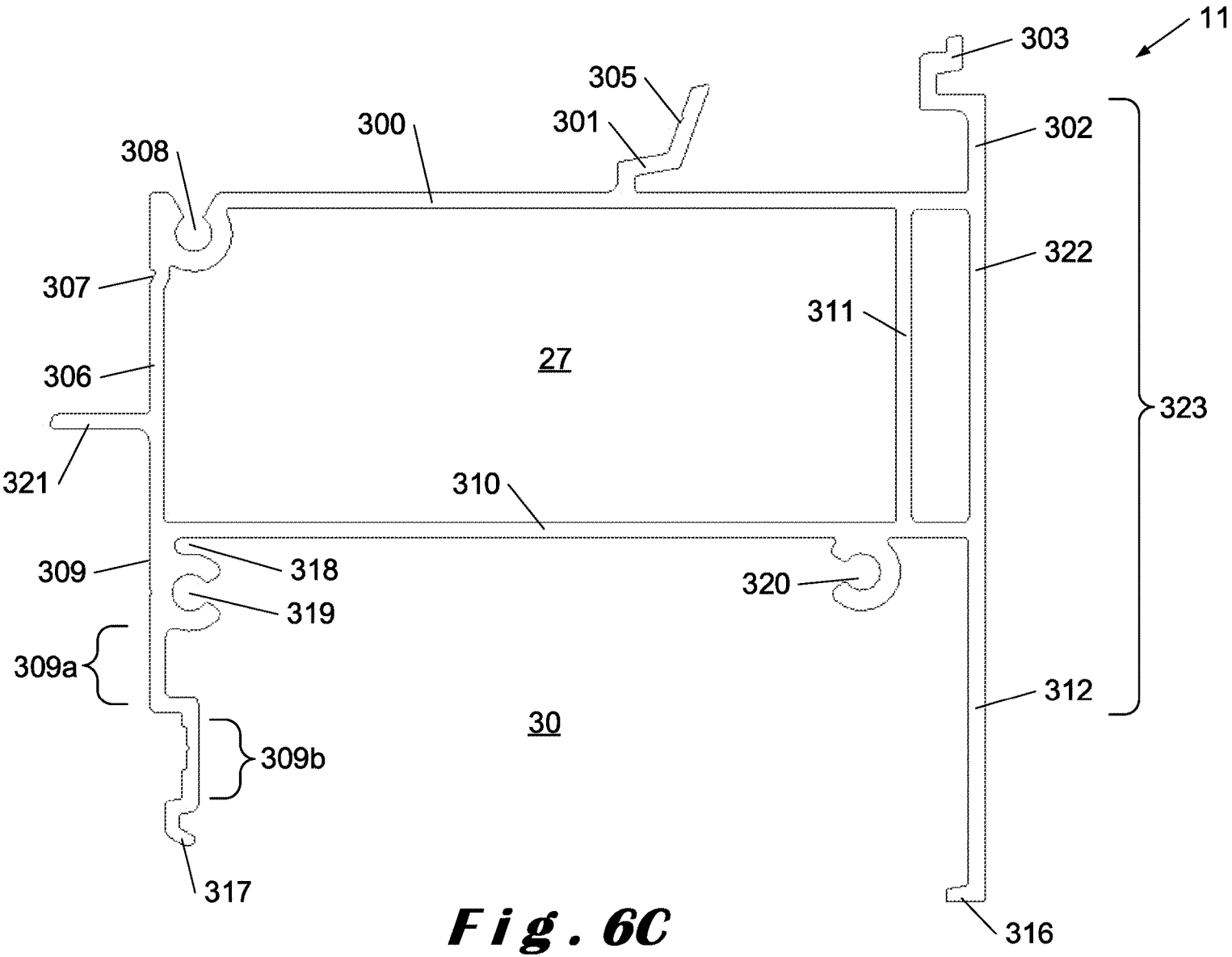

The single gutter profile 11 is shown in more detail in FIG. 6C. In view of the many similarities with the double gutter profile 13, it was decided to use the same numbering, but with the first digit "2" replaced by the digit "3". In concrete terms, the design at the top and the outer side of the gutter profiles 11, 13 is identical, such that a further description of elements 300 to 312 and 317 to 321 is superfluous.

The modifications of the single gutter profile 11 compared to the double gutter profile 13 are therefore located on the inner side of this profile, where now no external gutter 28 is present. An additional upright wall part 322 is therefore placed, which is parallel to the intermediate wall 311 (which, for the sake of clarity, in the embodiment of a single gutter profile, is not provided with openings). In this way, the upright walls 302, 312, 322 together form the inner upright wall 323 of the single gutter profile 11. This is also the externally visible wall, seen by someone located below the terrace canopy 1. Furthermore, the lower inner connection means 316, particularly a hooking means, is also substantially identical to connection means 216, with the difference that the hook only extends outwardly such that the finish of wall 323 is uninterrupted.

Although only one embodiment of a tension beam 5 has been shown, it is understood that the only difference between an external pivot beam 3 and a tension beam 5 is the shape of the gutter profile 11, 13. Hence, the invention also relates to multiple tension beams having the same functionality of the external pivot beams shown in FIGS. 3A to 3C and 3E to 3J where the double gutter profile 13 is replaceable by the single gutter profile 11 of FIG. 6C.

Figure 5:
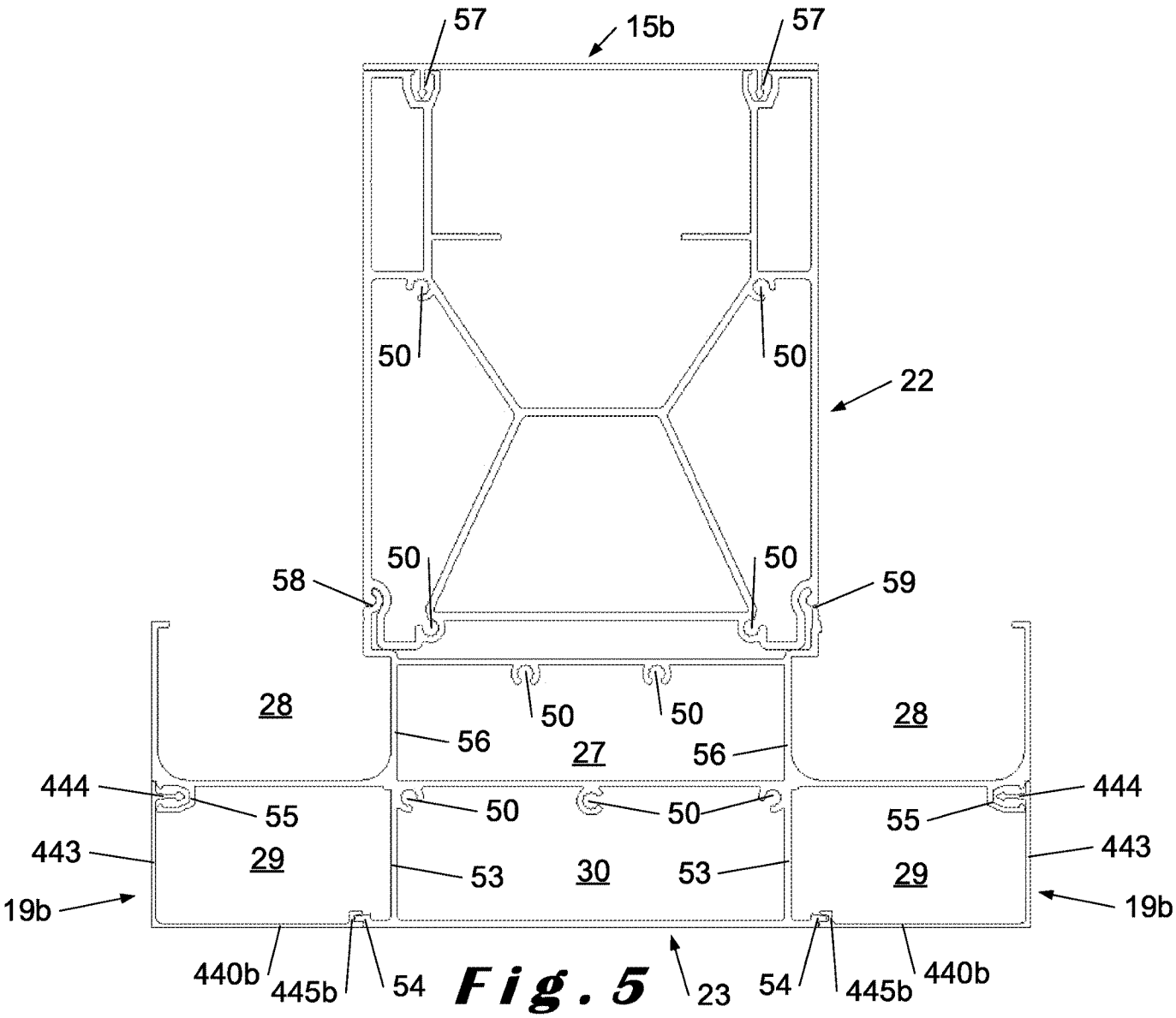
FIG. 5 shows a section through an embodiment of a central pivot beam.

FIG. 5 illustrates a central pivot beam 4. Since the central pivot beam 4 is centrally located in the terrace canopy 1, it is not the intention that a side wall can be located below the beam 4, which changes the design of a whole number of profiles. Of course, it cannot be ruled out that a wall infill may be present below the central pivot beam 4.

The central pivot beam 4 is constructed from a limited number of profiles, namely a base profile 22, a gutter profile 23, a cover profile 15*b* and two closure profiles 19*b*. The base profile 22 has a symmetrical construction and is connected to the gutter profile 23 by means of connections 58, 59. Connections 58, 59 have a different design, whereby connection 58 is shown as a hook connection. However, these connections can be identical to each other. At its top side, the base profile 22 is sealed by a cover profile 15*b* by means of pin connections 57. The gutter profile 23 comprises two external gutters 28 and the central gutter 27 which are separated by intermediate walls 56. For finishing at the bottom side below the external gutters 28, use is made of two closure profiles 19*b* identical to the one described with reference to FIG. 3E. In particular, the attachment uses a connection means 55, in particular a female pin connection means, below the external gutters 28, which cooperates with pin 444, and a lower connection means 54, in particular a hooking means, forming the end of the branch 53 and cooperating with hook 445*b*. Furthermore, the central pivot beam 4 is also provided with screw channels 50 for screwing a headboard onto an end of this beam 4 by means of screws or bolts.

It should be understood that finishing profile 19*b* can also be replaced by LED-holder profile 10, described with reference to FIG. 3K. If necessary, it is also possible to replace the finishing profile 19*b* with wall profile 21 described with reference to FIG. 3D. Optionally, the space 30 below the internal gutter 27 may also be used for a wall profile.

While certain aspects of the present invention have been described with respect to specific embodiments, it is understood that these aspects may be implemented in other forms within the scope as defined by the claims.

The invention claimed is:

1. A terrace canopy comprising a beam, the beam having a top side, a bottom side, an inner side and an outer side, and comprising a base part that, in its cross-section, is provided with:

a screen cavity configured to hold a screen roller, which screen cavity is delimited by an upright inner side wall and a horizontal top wall extending from the upright inner side wall in a direction of the outer side of the beam;

an upright outer side wall extending from an end of the horizontal top wall and provided at the top with a first upper connection means; and an internal space above the screen cavity, wherein the upright outer side wall, on its outwardly facing side, is provided with a first connection means, wherein the beam is further provided with: a wall profile and a second closure profile, wherein the wall profile is located on the outer side of the upright outer side wall and is configured to guide and/or hold a wall panel and is provided with a first complementary connection means, a second complementary connection means and a first upper connection means, the wall profile being connected to the base part by connecting its first complementary connection means to the first upper connection means and its second complementary connection means to the first connection means, wherein the second closure profile closes off the internal space and is provided with a first complementary connection means, wherein the second closure profile is connected to the wall profile by connecting its first complementary connection means to the first upper connection means of the wall profile, and wherein the wall profile and the second closure profile can be removed and said second closure profile can be replaced by a first closure profile and vice versa, wherein said first closure profile can close off the internal space and is provided with a first complementary connection means, the first closure profile being able to be connected to the base part by connecting its first complementary connection means to the first upper connection means.

2. The terrace canopy according to claim 1, wherein the upright inner side wall is provided at the top with a second upper connection means, wherein the first closure profile and the second closure profile are each provided with a second complementary connection means, wherein the first closure profile is connected to the base part by connecting its second complementary connection means to the second upper connection means and wherein the second closure profile is connected to the base part by connecting its second complementary connection means to the second upper connection means.

3. The terrace canopy according to claim 2, wherein the second upper connection means comprises a female pin connection means and in that the second complementary connection means comprises a male pin connection means.

4. The terrace canopy according to claim 1, wherein the first upper connection means comprises a female pin connection means and in that the first complementary connection means of each closure profile comprises a male pin connection means.

5. The terrace canopy according to claim 1, wherein the first upper connection means and the first connection means each comprises a hook element, and that the first complementary connection means and the second complementary connection means of the wall profile comprises a hook element.

6. The terrace canopy according to claim 1, wherein the first upper connection means comprises a female pin connection means and a hook element.

7. The terrace canopy according to claim 1, wherein the internal space is delimited by the horizontal top wall, the upright outer side wall and the upright inner side wall.

8. The terrace canopy according to claim 1, wherein the wall profile comprises a rail configured to hold and guide at least one wall panel.

9. The terrace canopy according to claim 1, wherein an outwardly facing surface of the second closure profile and an outwardly facing surface of an outer side wall of the wall profile lie substantially in the same plane.

10. The terrace canopy according to claim 1, wherein the beam comprises a gutter part which is located below the base part and is configured for draining a precipitation incident on the terrace canopy to a front end of the beam.

11. The terrace canopy according to claim 10, wherein the base part and the gutter part are formed as separate profiles, wherein the upright inner side wall of a base profile at the bottom is provided with at least one, preferably at least two, connection means and in that a gutter profile is provided with at least one, preferably at least two, corresponding connection means for connecting the base profile to the gutter profile.

12. The terrace canopy according to claim 1, wherein the horizontal top wall near its end is provided with a second connection means.

13. The terrace canopy according to claim 12, wherein the second connection means comprises a plurality of connection means.

14. The terrace canopy according to claim 1, wherein the wall profile comprises a rail configured for guiding at least one wall part.

15. A terrace canopy comprising a beam, the beam having a top side, a bottom side, an inner side and an outer side, and comprising a base part that, in its cross-section, is provided with:

a screen cavity configured to hold a screen roller, which screen cavity is delimited by an upright inner side wall and a horizontal top wall extending from the upright inner side wall in a direction of the outer side of the beam;

an upright outer side wall extending from an end of the horizontal top wall and provided at the top with a first upper connection; and an internal space above the screen cavity, wherein the upright outer side wall, on its outwardly facing side, is provided with a first connection, wherein the beam is further provided with: a wall profile and a second closure profile, wherein the wall profile is located on the outer side of the upright outer side wall and is configured to guide and/or hold a wall panel and is provided with a first complementary connection, a second complementary connection and a first upper connection, the wall profile being connected to the base part by connecting its first complementary connection to the first upper connection and its second complementary connection to the first connection, wherein the second closure profile closes off the internal space and is provided with a first complementary connection, wherein the second closure profile is connected to the wall profile by connecting its first complementary connection to the first upper connection of the wall profile, and wherein the wall profile and the second closure profile can be removed and said second closure profile can be replaced by a first closure profile and vice versa, wherein said first closure profile can close off the internal space and is provided with a first complementary connection, the first closure profile being able to be connected to the base part by connecting its first complementary connection to the first upper connection.

16. The terrace canopy according to claim 15, wherein the upright inner side wall is provided at the top with a second upper connection, wherein the first closure profile and the second closure profile are each provided with a second complementary connection, wherein the first closure profile is connected to the base part by connecting its second complementary connection to the second upper connection and wherein the second closure profile is connected to the base part by connecting its second complementary connection to the second upper connection.

17. The terrace canopy according to claim 16, wherein the second upper connection comprises a female pin connection and in that the second complementary connection comprises a male pin connection.

18. The terrace canopy according to claim 15, wherein the first upper connection comprises a female pin connection and in that the first complementary connection of each closure profile comprises a male pin connection.

19. The terrace canopy according to claim 15, wherein the first upper connection and the first connection each comprises a hook element, and that the first complementary connection and the second complementary connection of the wall profile comprises a hook element.

20. The terrace canopy according to claim 15, wherein the first upper connection comprises a female pin connection and a hook element.

* * * * *